US006426588B1

(12) United States Patent
Yanagisawa

(10) Patent No.: US 6,426,588 B1
(45) Date of Patent: Jul. 30, 2002

(54) METHOD FOR PRODUCING IMAGE-FORMING APPARATUS, AND IMAGE-FORMING APPARATUS PRODUCED USING THE PRODUCTION METHOD

(75) Inventor: Yoshihiro Yanagisawa, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/435,773

(22) Filed: Nov. 8, 1999

(30) Foreign Application Priority Data

Feb. 18, 1999 (JP) ..... 11-039581
Oct. 26, 1999 (JP) ..... 11-304134

(51) Int. Cl.[7] ..... H01J 1/30
(52) U.S. Cl. ..... 313/422; 445/24; 257/698
(58) Field of Search ..... 445/24, 25; 174/52.4; 257/698; 313/422

(56) References Cited

U.S. PATENT DOCUMENTS 3,673,309 A * 6/1972 Dahnasso ..... 174/52.4
4,635,165 A * 1/1987 Okuaki ..... 174/52.4
5,866,988 A * 2/1999 Oda ..... 313/309

FOREIGN PATENT DOCUMENTS

EP 275052 * 7/1988
JP 06-342636 12/1994
JP 07-181901 7/1995
JP 08-034110 2/1996
JP 08-045448 2/1996
JP 09-277586 10/1997

* cited by examiner

*Primary Examiner*—Kenneth J. Ramsey
(74) *Attorney, Agent, or Firm*—Fitzpatrick, Cella, Harper & Scinto

(57) ABSTRACT

An airtight vessel is formed with restraining a vacuum leak and without increase in the number of steps. Provided is a method for producing an image-forming apparatus comprising the airtight vessel in which a rear plate having an electron-emitting device and a wire connected to the element, and a face plate having an electrode are joined to each other through a jointing material, the method comprising the following steps: (A) a first step of forming a first wire which is a part of the wire and which passes through the joint part to connect the inside of the vessel to the outside, by applying a paste comprising particles of an electric conductor and baking the paste; and (B) a second step of forming a second wire located in the vessel, by applying a paste comprising particles of an electric conductor so as to be connected to the first wire inside the vessel and baking the paste, after formation of the first wire.

16 Claims, 15 Drawing Sheets

METHOD FOR PRODUCING IMAGE-FORMING APPARATUS, AND IMAGE-FORMING APPARATUS PRODUCED USING THE PRODUCTION METHOD

BACKGROUND OF THE INVENTION

1. Field of the Invention

The present invention relates to a method for producing an image-forming apparatus while keeping the inside in a pressure-reduced state. Particularly, the invention relates to a method for producing the image-forming apparatus while wires used in the image-forming apparatus are formed by sintering particles of an electric conductor. The invention further concerns the image-forming apparatus produced using the production method.

2. Related Background Art

Cathode-ray tubes (CRTs) are popularly and generally used as the image-forming apparatus at present. Recently, the large cathode-ray tubes with the display screen over 30 inches also came on the market. In order to increase the size of the display screen in the case of the cathode-ray tubes, however, there arise problems that the depth dimension thereof must be increased according to the increase of the screen size and that the weight also becomes greater according to the increase of the screen size.

In order to meet the consumer's desires for images of strong appeal on a larger screen, the cathode-ray tubes thus require a larger placement space and thus are not always suitable for realizing the increase of the screen size.

There are thus expectations for the debut of a flat image display apparatus that is thin enough to be hung on a wall, that is of low power consumption, and that has a thin, lightweight, large screen, in place of the large and heavy cathode-ray tubes (CRTs). Research and development is active on liquid-crystal display devices (LCDs) as such flat image display apparatus.

Since the above LCDs are not of an emissive type, they require a light source called a back light. They thus had a problem that most of the power consumption was due to lighting of the back light. Further, the LCDs still have problems that the image is dark because of low utilization efficiency of light, there is a limit to viewing angles, it is difficult to realize a large screen over 20 inches, and so on.

An emissive type flat image display apparatus is thus drawing attention instead of the LCDs having the above problems. Examples of such display apparatus proposed heretofore are, for example, plasma display panels (PDPs) arranged to emit light by irradiating a fluorescent material with ultraviolet light to excite the fluorescent material, flat panel displays arranged to emit light by irradiating the fluorescent material with electrons emitted from electron-emitting devices to excite the fluorescent material, and so on.

With the displays using the electron-emitting devices, the fluorescent material is made to emit light when the fluorescent material is irradiated with electrons emitted from the devices under reduced pressure. Therefore, the light emission mechanism thereof is thus basically the same as in the case of the CRTs. This permits us to expect high-luminance displays without viewing angle dependence.

Such electron-emitting devices are generally classified into cold cathodes and thermionic cathodes. Further, the cold cathodes include field emission type electron-emitting device (hereinafter referred to as "FE"), electron-emitting device comprised of a stack of metal layer/insulating layer/metal layer (hereinafter referred to as "MIM"), surface conduction electron-emitting device, and so on.

In the image display apparatus using the above electron-emitting devices, the devices need to operate in an airtight vessel maintained, for example, under a pressure lower than $10^{-4}$ Pa.

The image display apparatus using the surface conduction electron-emitting devices among the above cold cathode is disclosed, for example, in Japanese Patent Applications Laid-Open No. 6-342636, No. 7-181901, No. 8-034110, No. 8-045448, No. 9-277586, and so on.

FIG. 5 and FIG. 6 show the schematic structure of an example of the surface conduction electron-emitting devices disclosed in the above applications. FIG. 7 is a diagram to show the schematic structure of an example of the image display apparatus using the surface conduction electron-emitting devices disclosed in the above applications.

FIG. 5 is a plan view of the surface conduction electron-emitting device and FIG. 6 is a cross-sectional view of the surface conduction electron-emitting device. In FIG. 5 and FIG. 6, reference numeral 101 designates an insulating substrate, 104 an electroconductive film, 102 and 103 electrodes, and 105 an electron-emitting region. The electron-emitting region 105 has a gap. When a voltage is placed between the electrodes 102, 103, the electron-emitting region 105 emits electrons.

In FIG. 7 numeral 5005 denotes a rear plate, 5006 an outer frame, and 5007 a face plate. Joint (Sealing) portions between the outer frame 5006, the rear plate 5005, and the face plate 5007 are joined (or sealed) to each other with a bonding material such as a low-melting-point glass frit or the like not illustrated, thereby composing an airtight vessel 170 for maintaining the inside of the image display apparatus in vacuum. The surface conduction electron-emitting devices 5002 are formed in an array of N×M on the rear plate 5005 (where N and M are positive integers not less than 2 and are properly determined according to the number of display pixels aimed). A fluorescent material is opposed to the electron-emitting devices.

The electron-emitting devices 5002 are wired in a matrix by M column-directional wires 107 and N row-directional wires 106, as illustrated in FIG. 7. In the case of this wiring in the matrix, insulating layers, not illustrated, are placed for electrically insulating the two types of wires from each other, at least, at intersecting portions between the row-directional wires and the column-directional wires.

A fluorescent film 5008 comprised of the fluorescent material is formed on the lower surface of the face plate 5007. A metal back 5009 of Al or the like is formed on the rear-plate-side surface of the fluorescent film 5008.

In the case of color display, fluorescent materials (not illustrated) of the three primary colors, red (R), green (G), and blue (B), are laid separately. Further, a black material (not illustrated) is laid between the fluorescent materials of the respective colors forming the fluorescent film 5008.

The inside of the-above airtight vessel is maintained in a vacuum of the pressure lower than $10^{-4}$ Pa. The distance between the rear plate 5005 with the electron-emitting devices formed thereon and the face plate 5007 with the fluorescent film formed thereon, as described above, is usually kept in the range of several hundred $\mu$m to several mm.

A method for driving the image-forming apparatus described above is as follows. A voltage is applied to each electron-emitting device 5002 via terminals Dx1 to Dxm, Dy1 to Dyn outside the vessel, and via the wires 106, 107, whereby each device 5002 emits electrons. At the same time as it, a high voltage of several hundred V to several kV is applied to the metal back 5009 via a terminal Hv outside the vessel. This accelerates the electrons emitted from each device 5002 to make them collide with the corresponding fluorescent material of each color. On this occasion the fluorescent material is excited to emit light, thus displaying an image.

SUMMARY OF THE INVENTION

In recent years there are needs for further increase of the screen size in the image-forming apparatus. In order to produce the image-forming apparatus of several ten inches at low cost, it is then desirable to form the above wires by a sintering method (for example, a printing method) of applying conductive particles onto a substrate and baking them. Printing methods, particularly screen printing methods, are preferable, because wires of a thick film can be produced at low cost thereby.

Incidentally, in the image-forming apparatus using the electron-emitting devices, the members (the outer frame 5006, the face plate 5007, and the rear plate 5005) forming the airtight vessel 170 are joined (sealed) to each other through the bonding material (for example, the frit glass or the like). The wires (5004, 5003) for driving the devices play a role of supplying the voltage to each device in the airtight vessel from a voltage generating source placed outside the airtight vessel 170. Therefore, the wires for driving the devices pass through the sealed area of the airtight vessel. The wires existing in the joint (sealed) part thus also function to maintain the vacuum in the airtight vessel 170 in cooperation with the bonding material.

On the other hand, the wires formed by the printing method are usually produced in such a way that a paste is prepared by blending particles of the electric conductor (for example, metal powder), a binder, a solvent, etc., the paste is applied onto the substrate, and then it is baked to remove the binder and the like.

The wires formed by the above method are thus aggregates (sintered bodies) of the particles of the conductor (for example, metal) and low packing density in some cases. The packing density herein is specifically the distance of clearance and existence of gap between the particles of the conductor (for example, metal) approximately.

Speaking of the airtight vessel 170 illustrated in FIG. 7, where the wires passing through the joint (sealed) part between the outer frame and the glass substrate (5007 or 5005) are formed by the above method, the existence of many clearances described above will cause the pressure to gradually increase inside the airtight vessel 170. In the worst case, the image-forming apparatus using the electron-emitting devices, which require the high vacuum, would fail to operate because of the increase of the pressure.

In the image-forming apparatus having the matrix of wires formed as illustrated in FIG. 7, the column-directional wires 107 are formed on the rear plate 5005. The insulating layers are formed on the column-directional wires 107, at least, at the intersecting portions between the row-directional wires 106 and the column-directional wires 107. Then the row-directional wires are formed continuously on laminates of the insulating layers and the column-directional wires and on the rear plate. Consequently, the row-directional wires are formed in greatly stepped portions, different from the column-directional wires formed on the nearly flat surface. There were cases wherein the position accuracy of the row-directional wires was degraded and wherein electric connections became poor at the step portions.

An object of the present invention is, therefore, to restrain a vacuum leak which is assumed to be caused by the structure of the wires at the joint part (sealing part) of the airtight vessel described above. Another object of the invention is to form the wires with accuracy and good electric connections at the step portions. A further object of the invention is to provide a method for producing the airtight vessel that can maintain a high vacuum over a long period, without increase of the time necessary for production steps of the airtight vessel. Still another object of the invention is to provide an image-forming apparatus that can form stable images over a long period.

In order to accomplish the above objects, the present invention comprises the following:

a method for producing an image-forming apparatus comprising an airtight vessel in which a rear plate having an electron-emitting device and a wire connected to the device, and a face plate having an electrode-are joined (sealed) to each other through a bonding material, said method comprising a first step of forming a first wire which is a part of said wire and which passes through said sealing part to connect the inside of said vessel to the outside, by applying a paste comprising particles of an electric conductor and baking the paste, and a second step of forming a second wire located in said vessel, by applying a paste comprising particles of an electric conductor so as to be connected to the first wire inside said vessel and baking the paste, after formation of said first wire.

In the production method according to the present invention, the wire located in the joint (sealing) part can be baked for a long time. As a result, the leak is restrained at the joint (sealing) part, so that stable image formation can be carried out over a long period.

The present invention is further characterized in that the wire comprises a plurality of row-directional wires extending in a row direction and a plurality of column-directional wires extending in a direction substantially perpendicular to the row direction and electrically insulated from the row-directional wires and in that the row-directional wires are formed by the first step and the second step. The invention is also characterized in that the column-directional wires are formed in the same step as the first step of forming the row-directional wires.

The formation of the matrix wires in this way can assure a long baking time of the wires located at the joint (sealing) part (i.e., takeout portions) without substantially increasing the number of steps for formation of the wires.

The present invention is also characterized in that the insulating layer is formed in a pattern of lines extending in the row direction and is formed so as to be connected to parts of the row-directional wires formed in the first step. The present invention is further characterized in that the thickness of the row-directional wires is greater than that of the column-directional wires.

The formation in this way can restrain occurrence of discontinuity or an electrical connection failure at the step portions of the row-directional wires.

The present invention is also characterized in that the electron-emitting device comprises a first electrode and a second electrode and in that the method further comprises a step of forming the first electrode and the second electrode, prior to said first step.

The formation in this way can make securer the electric connections between the wires and the electron-emitting device.

DETAILED DESCRIPTION OF THE PREFERRED EMBODIMENTS

The following will describe an example of the structure of the image-forming apparatus to which the present invention is suitably applicable, and an example of the production method of the image-forming apparatus. They are described using the example of the image-forming apparatus using the surface conduction electron-emitting devices as the aforementioned electron-emitting devices. The electron-emitting devices to which the present invention is preferably applicable are basically those having to be driven under reduced pressure as described previously. Further, the present invention can also preferably be applied to the image-forming apparatus using the two-terminal cold cathodes such as the aforementioned FE, MIM, surface conduction electron-emitting devices, and so on. Further, the present invention can most preferably be applied to the image-forming apparatus using the surface conduction electron-emitting devices that can be formed over a large area at low cost.

Figure 10:
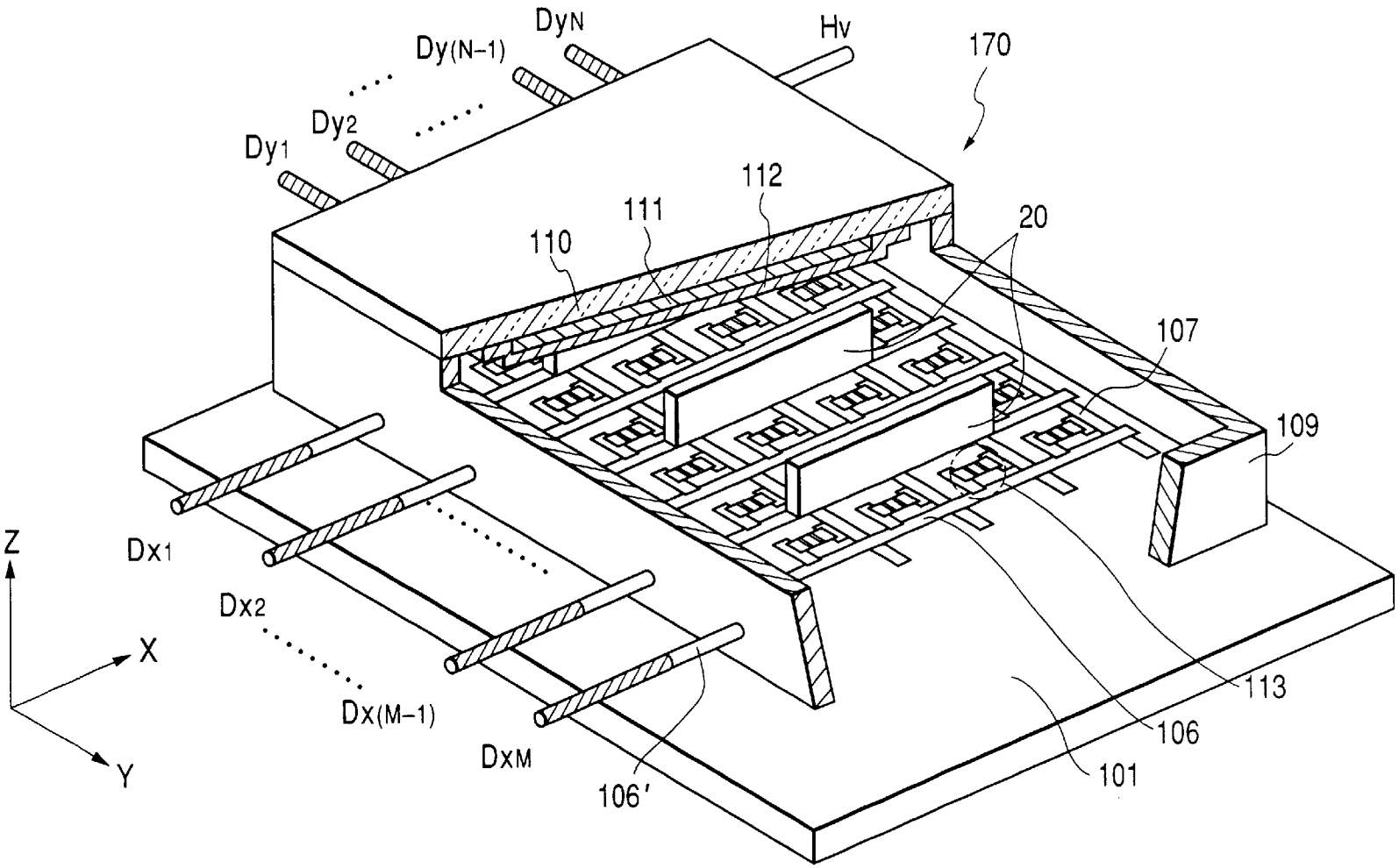
FIG. 10 is a perspective view of an image-forming apparatus produced in Embodiments.

FIG. 10 is a schematic diagram to show an example of the structure of the image display apparatus (flat panel display) to which the present invention is preferably applicable, and a part thereof is cut away for convenience' sake of explanation. In FIG. 10 reference numeral 101 designates a rear plate, 109 an outer frame, and 110 a face plate. The joint (sealing) portions between the outer frame 109, the rear plate 101, and the face plate 110 are sealed with a bonding material not illustrated, thus composing an airtight vessel (hermetic container) 170. The low-melting-point frit glass was used as the above bonding material herein, but other materials can also be used as the bonding material.

In the case of the image-forming apparatus wherein the distance between the rear plate 101 and the face plate 110 is set in the micrometer order, there are also cases in which the rear plate and the face plate are joined (sealed) directly to each other with the bonding material, without use of the outer frame 109. In such cases, the gap between the rear plate and the face plate is defined by the thickness of the bonding material. It is thus understood that the outer frame 109 is not always necessary in the present invention.

The area of the rear plate is set greater than the area surrounded by the outer frame 109. This is for the purpose of readily connecting the driving circuit placed outside the airtight vessel to the wires inside the airtight vessel, on the rear plate. Therefore, row-directional wire takeout portions 106' and column-directional wire takeout portions 107' (not illustrated) extending out from the inside of the airtight vessel are also formed on the rear plate 101 outside the area surrounded by the outer frame (the bonding material). FIG. 10 shows the example in which the row-directional wires 106 are formed so as to extend in two directions from the inside of the airtight vessel to the outside of the airtight vessel 170. However, if a voltage drop in the column-directional wires is not negligible, either there are also cases wherein the column-directional wires are formed so as to extend in two directions from the inside of the airtight vessel to the outside of the airtight vessel as well. Further, the number of takeout directions of the wires from the inside of the airtight vessel to the outside of the airtight vessel is set properly, depending upon the electron-emitting devices used, addition of a focusing electrode, and so on.

In the present invention the "takeout portion" means a wire that extends from a wire located inside the airtight vessel to the outside of the airtight vessel and this is formed on the rear plate. It is, however, noted that the "takeout portions" are not always formed separately from the wires located inside the airtight vessel. Namely, in the image-forming apparatus having the row-directional and column-directional wires as illustrated in FIG. 10, there are also cases in which the column-directional wires 107 are made by simultaneously forming the wires located inside the airtight vessel (the area surrounded by a dotted line indicated by numeral 2 in FIGS. 1A to 1C) and the takeout portions (see FIGS. 1A to 1C).

The surface conduction electron-emitting devices 113 are formed in an array of N×M on the rear plate 101 (where N and M are positive integers not less than 2 and are properly set according to the number of display pixels aimed). The electron-emitting devices and the fluorescent materials of the respective colors are arranged in one-to-one correspondence as being opposed to each other. The above numbers N and M are determined depending upon the display area of the image-forming apparatus produced, the definition of display image, and the aspect ratio of display image. In the present example N is 3000 and M is 1000, but it should be noted that the invention is not limited to these numbers.

The devices 113 are wired in a matrix by the N column-directional wires 107 arranged in a first direction (Y-direction) and the M row-directional wires 106 arranged in a second direction (X-direction), as illustrated in FIG. 10.

In the present invention the wires arranged in the matrix are also sometimes called in such a way that the wires placed on the lower side (the rear plate side) are called lower wires while the wires placed on the upper side are called upper wires. Namely, in the case of FIG. 10, the column-directional wires 107 are the lower wires, while the row-directional wires 106 the upper wires.

The thickness of the wires located on the lower side is equal to or smaller than that of the wires located on the upper side. The reason is that the wires located above are formed over and across the wires located below and a level difference of the steps is made as small as possible by such arrangement.

Particularly, in the case of the image-forming apparatus using the lateral type electron-emitting devices among the aforementioned electron-emitting devices, the larger the area of the forming image, the greater the thickness of the row-directional wires needs to be set than the thickness of the column-directional wires. The lateral type electron-emitting device stated herein means a device in which at least a pair of electrodes are placed in a same plane on the rear plate and in which a potential difference is made between the electrodes to emit electrons from between the pair of electrodes.

Figure 13:
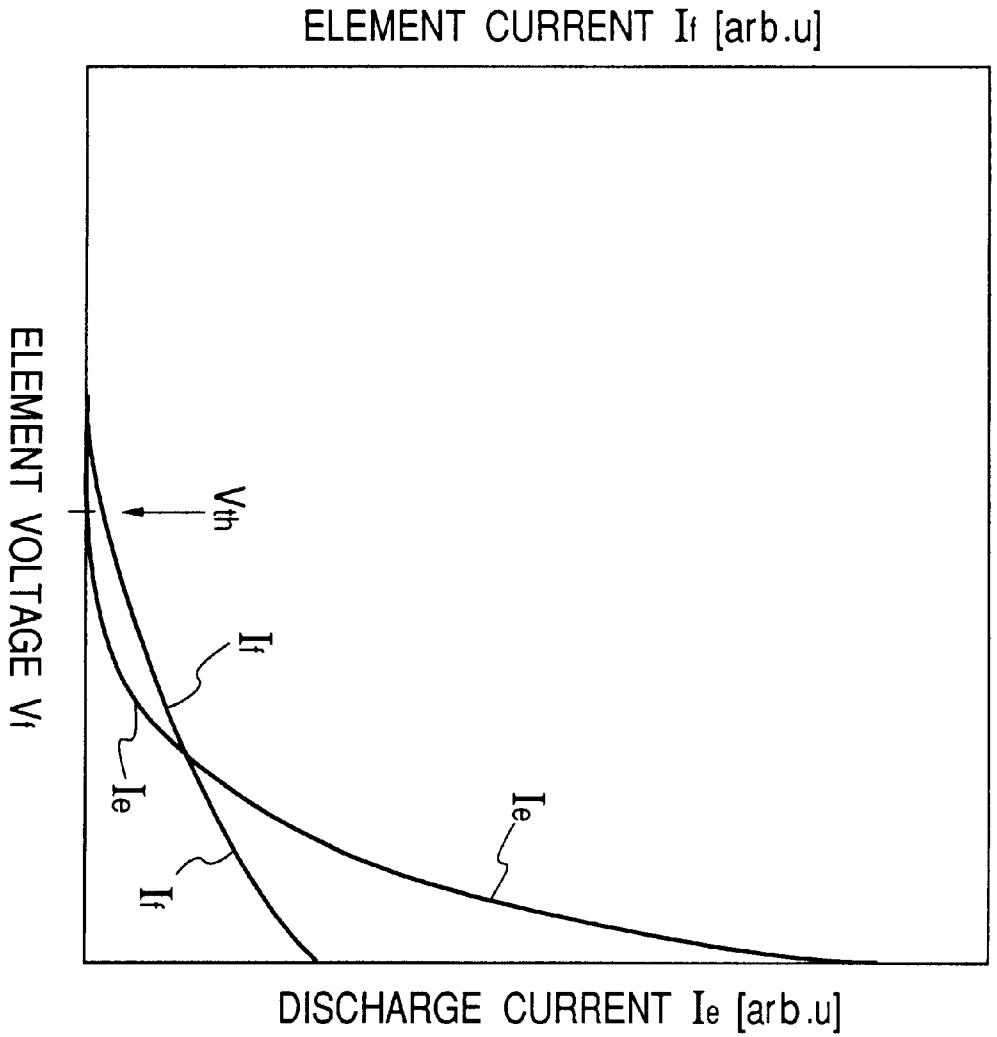
FIG. 13 is a schematic diagram to show voltage-current characteristics of the transverse electron-emitting device.

In the lateral type electron-emitting device, all electric current flowing to the electron-emitting region does not become emission current. FIG. 13 schematically shows the relation between the emission current (Ie) and the device current (If) flowing between the electrodes, against the voltage (Vf) applied between the electrodes of the lateral type electron-emitting device. At the same time as emission of electrons, reactive current (If) starts to flow between the electrodes. This tendency is common to the lateral type electron-emitting devices. In FIG. 13, Vth is a voltage at which the emission current Ie starts to be measured.

Accordingly, with the image-forming apparatus using the surface conduction electron-emitting devices of the present example, particularly, where line sequential scanning of the row-directional wires is carried out, the resistance of the row-directional wires needs to be lower than that of the column-directional wires. The reason is as follows. When the lateral type electron-emitting devices having the flow of If as described above are matrix-driven, more current flows in the row-directional wires to which the larger number of electron-emitting devices are connected on a common basis. Therefore, the resistance of the wires themselves needs to be controlled below that of the column-directional wires. Specifically, the resistance of the wires is decreased without deterioration of the definition of forming image, by setting the thickness of the row-directional wires greater than that of the column-directional wires.

For the above reason, particularly, in the case of the image-forming apparatus using the electron-emitting devices that creates more current (If) flowing in the devices without becoming the emission current (Ie), such as the lateral type electron-emitting devices or the like, the thickness of the wires over and across which the upper wires pass is decreased by using the thinner wires as the aforementioned lower wires and the thicker wires as the aforementioned upper wires.

Figure 5:
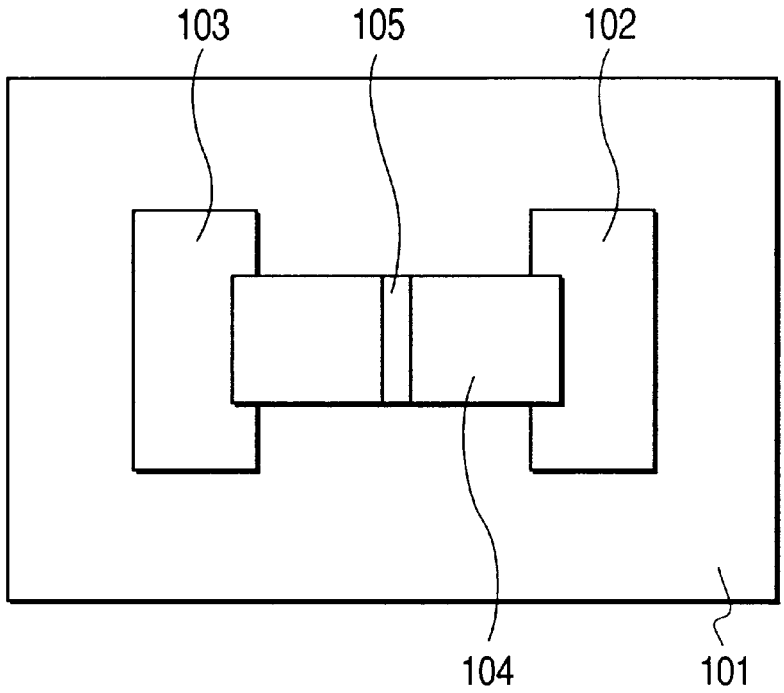
FIG. 5 is a plan view to show the structure of the surface conduction electron-emitting device.
Figure 6:
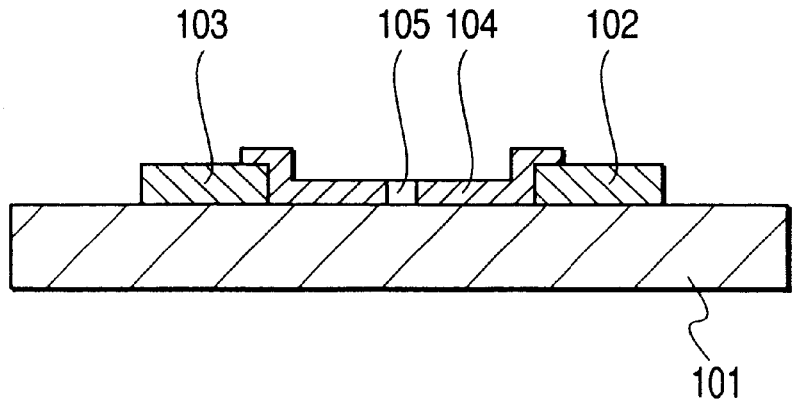
FIG. 6 is a sectional view to show the structure of the surface conduction electron-emitting device.
Figure 7:
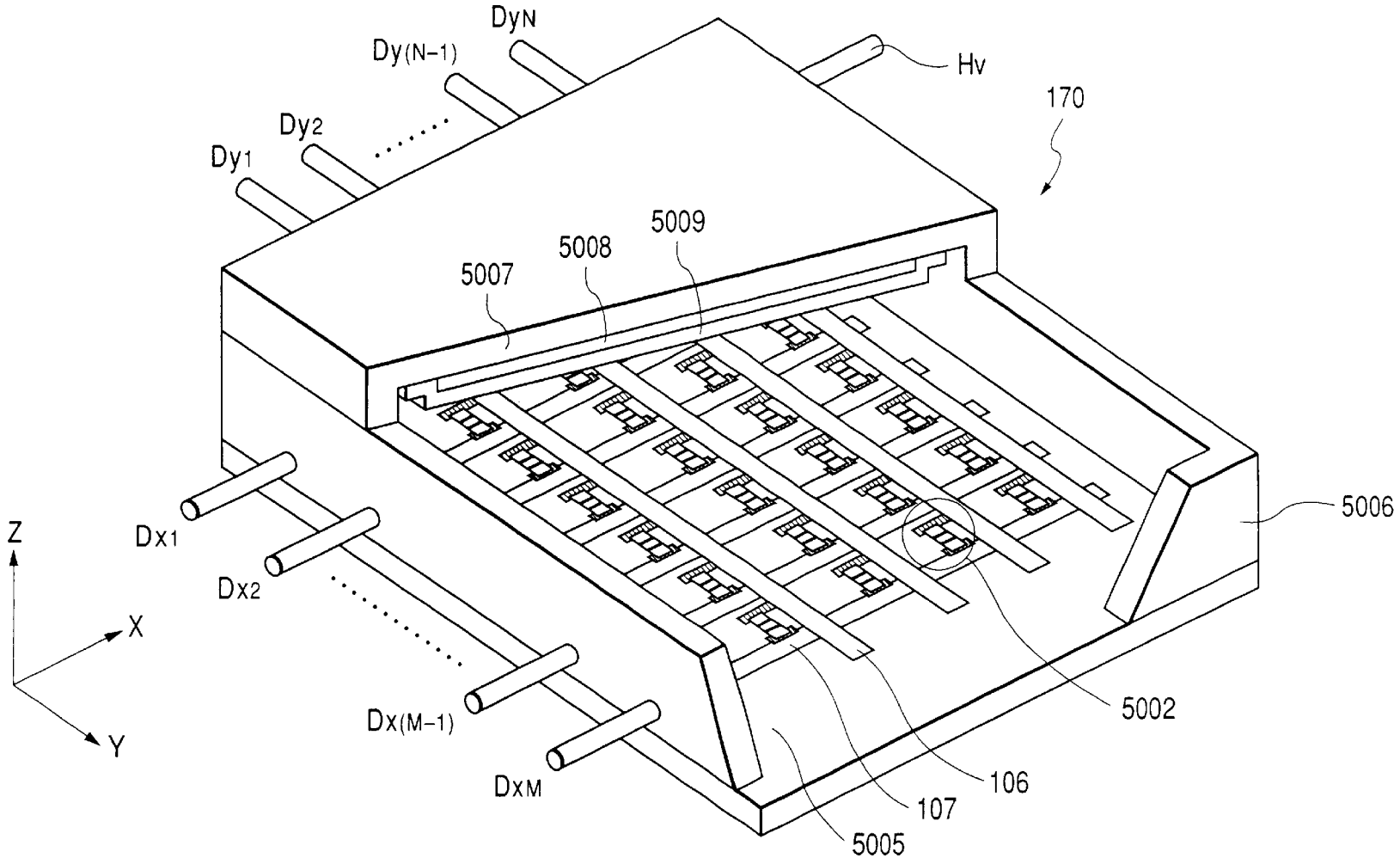
FIG. 7 is a perspective view to show an example of the image display apparatus using the surface conduction electron-emitting devices.
Figure 8:
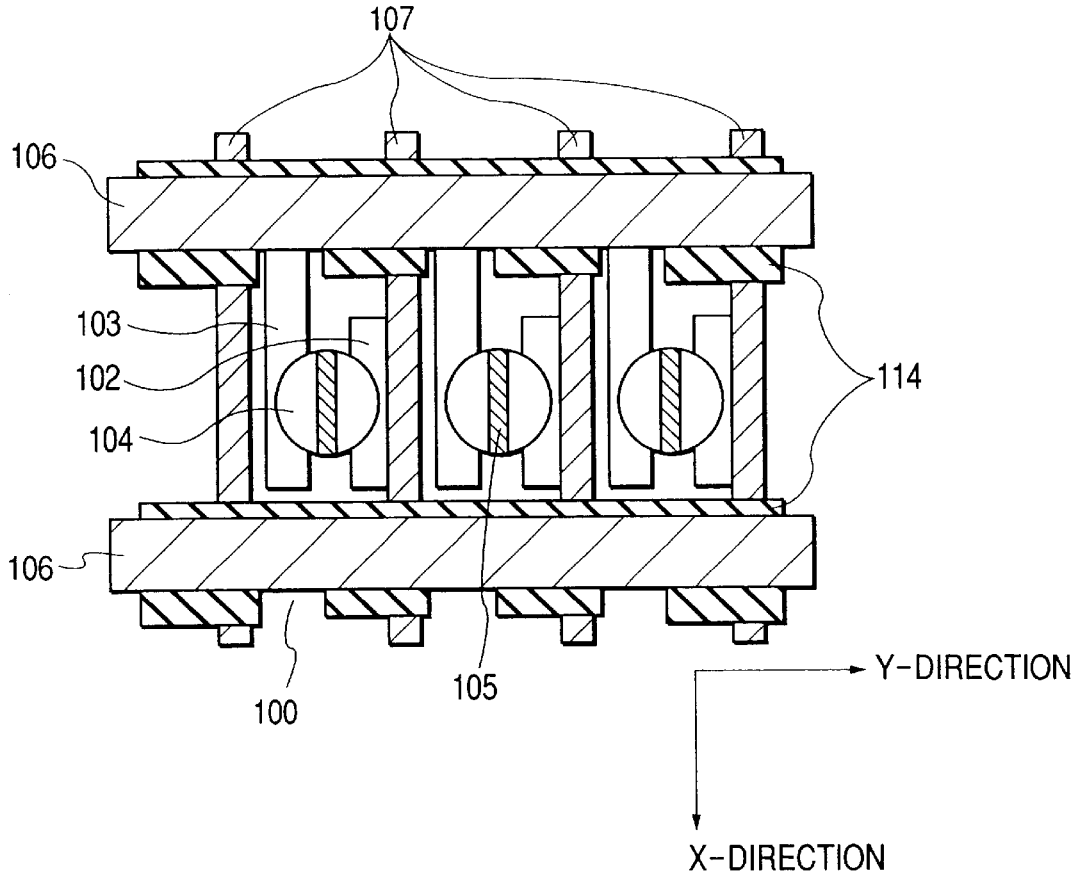
FIG. 8 is a schematic diagram to show an enlarged view of a part of the rear plate using the surface conduction electron-emitting devices.

FIG. 8 is a schematic diagram to show an enlarged view of a part of the column-directional wires 107, the row-directional wires 106, and the surface conduction electron-emitting devices 113 formed on the rear plate 101. The structure of the devices 113 themselves is the same as that illustrated in FIG. 5 and FIG. 6. However, the shape of conductive films 104 is illustrated as a circular shape specific to those produced by the ink jet method.

As illustrated in FIG. 8, insulating layers 114 for electrically insulating the both wires from each other are formed, at least, at intersecting portions between the row-directional wires 106 and the column-directional wires 107.

The rear plate 101 can be made of one selected from quartz glass, glass containing a decreased content of impurities such as Na or the like, soda lime glass, a glass substrate obtained by depositing $SiO_2$ on soda lime glass by sputtering or the like, ceramics such as alumina or the like, and so on.

Ordinary conductive materials can be used as a material of the opposed electrodes 102, 103. The material can be selected properly, for example, from metals such as Ni, Cr, Au, Mo, W, Pt, Ti, Al, Cu, Pd, and so on, or alloys thereof, printed conductors comprised of the metal or metal oxide of Pd, Ag, Au, $RuO_2$, Pd—Ag, or the like and glass or the like, transparent conductors such as $In_2O_3$—$SnO_2$ or the like, semiconductor materials such as polysilicon or the like, and so on.

The dimensions including the gap L between the electrodes 102 and 103, the electrode width W1, the width W2 of the conductive films 104, etc. are properly designed taking the form of application etc. into consideration. The gap L between the electrodes 102, 103 can be preferably in the range of several hundred nm to several hundred $\mu$m and more preferably in the range of several $\mu$m to several ten $\mu$m. The length W1 of the electrodes 102, 103 can be in the range of several $\mu$m to several hundred $\mu$m, taking the resistance and electron emission characteristics of these electrodes 102, 103 into consideration. The film thickness d of the electrodes 102, 103 can be in the range of several ten nm to several $\mu$m.

The electrodes 102, 103 are provided for making the electric connection secure between the conductive film 104 and the column-directional wire 107 or the row-directional wire 106. This is because there are cases in which sufficient connections cannot be made because of the difference between the thicknesses even if the conductive films 104 are intended to be connected directly to the wires 106, 107 described hereinafter.

A material for forming the conductive films 104 is selected properly from metals such as Pd, Pt, Ru, Ag, Au, Ti, In, Cu, Cr, Fe, Zn, Sn, Ta, W, Pd, and so on, semiconductors such as Si, Ge, etc., and oxides, borides, carbides, nitrides, etc. thereof. From the viewpoint of forming described hereinafter, use of Pd is particularly preferable in terms of easiness of adjustment of the resistance by oxidation and reduction.

The thickness of the conductive films 104 is set properly in consideration of step coverage over the electrodes 102, 103, the resistance of the electrodes 102, 103, the forming conditions described hereinafter, etc. and, normally, it is preferably in the range of 1 nm to several hundred nm and more preferably in the range of 1 nm to 50 nm. The resistance Rs of the films 104 is in the range of $10^2$ to $10^7$ [Ω/□]. This resistance Rs is a resistance computed based on R=Rs (L/w) where R is the resistance of the thin film having the thickness of t, the width of w, and the length of L.

The thickness of the electrodes 102, 103 described above is designed including the thickness of the above conductive films 104.

Since the conductive films 104 are very thin films, if they were formed prior to the formation of the wires and electrodes the baking temperature in the formation of the wires and electrodes could induce cohesion or the like of the films in certain cases. Therefore, the formation of the conductive films is preferably carried out after the formation steps of the electrodes 102, 103 and the wires 106, 107. Since the electrodes 102, 103 are thicker than the conductive films but sufficiently thinner than the wires 106, 107, the electrodes are formed on the rear plate, preferably, prior to the formation of the wires. Accordingly, a preferred order of production procedures is the formation step of the electrodes (102, 103), the formation step of the wires (106, 107) and the insulating layers (114), and the formation step of the conductive films. For good connections, it is particularly preferable to make the connections between the wires and the electrodes by covering parts of the electrodes with the wires.

From the above discussion, the order of the thicknesses from the thinnest is as follows; the conductive films (104), the electrodes (102, 103), the column-directional wires (107), and the row-directional wires (106).

The form of the insulating layers 114 is interdigital (or comblike) in FIG. 8, but it is not limited to this form. The point is that the insulating layers 114 are formed, at least, at the intersecting portions between the column-directional wires 107 and the row-directional wires 106.

In FIG. 8 the row-directional wires 106 are placed on the interdigital (comblike) insulating layers and are electrically connected to the electrodes while covering a part of one electrode forming each device 113 at indent portions 100 of the insulating layers 114. The column-directional wires 107 are electrically connected to the electrodes while covering a part of one electrode forming each device 113 in the case of FIG. 8. There are no specific restrictions on the material for the row-directional wires and the column-directional wires as long as it is an electric conductor. Preferred materials are materials resistant to oxidation when heated in the air; for example, preferably Ag, Au, Pt, and so on.

Dx1 to Dxm, Dy1 to Dyn, and Hv are terminals for electric connections, such as flexible cables or the like, provided for electrically connecting the image display device to an electric circuit not illustrated. Dx1 to Dxm are electrically connected to the row-directional wires 106' guided out of the inside of the airtight vessel 170 to the outside, on the rear plate 101 outside the outer frame 109 (in the air). Dy1 to Dyn are also electrically connected similarly to the column-directional wires 107' guided out of the inside of the airtight vessel 170 to the outside, on the rear plate 101 outside the outer frame 109 (in the atmosphere). Further, Hv is electrically connected to the metal back (the electrode for accelerating electrons emitted from the devices) 112.

The inside of the above airtight vessel is maintained under a pressure lower than $10^{-4}$ Pa. For that reason the increase in the display screen size of the image display device comes to require a means for preventing deformation or breakage of the rear plate 108 and the face plate 110 due to the pressure difference between the inside and the outside of the airtight vessel. Therefore, spacers 20 for resistance to the atmospheric pressure are placed between the face plate 110 and the rear plate 101 in the display of the present form illustrated in FIG. 10.

In this way the distance is kept in the range of several hundred $\mu$m to several mm between the substrate 101 on which the electron-emitting devices 113 are formed and the face plate 110 on which the fluorescent film is formed, and the inside of the airtight vessel 170 is maintained under a high vacuum. This example employed the fluorescent film and the metal back, but, for example, an ITO electrode, if placed, can serve as the electrode for accelerating electrons and also as the fluorescent film.

The image display apparatus described above operates so that each device 113 emits electrons when the voltage is applied to each electron-emitting device 113 through the outside terminals Dx1 to Dxm, Dy1 to Dyn, the row-directional wire 106, and the column-directional wire 107. At the same time as it, the high voltage of several hundred V to several kV is applied to the metal back 112 through the outside terminal Hv. This accelerates the electrons emitted from each device 113 to make them hit the corresponding fluorescent material of each color. They excite the fluorescent material to emit light, thus displaying an image.

For displaying a moving picture (video), while the row-directional wires 106 are successively selected one by one (with application of voltage), modulation signals for control according to video signal input are applied to the respective column-directional wires 107. The so-called line sequential driving is carried out in this way. In this line sequential scanning, devices selected at a time are one device by a column-directional wire and at most 3000 devices by a row-directional wire. A reason why the row-directional wires are used as the wires successively selected one by one is that the time for selection can be kept longer with the smaller number of wires.

The more detailed description about the driving of the above display panel will be given referring to FIG. 12.

Figure 12:
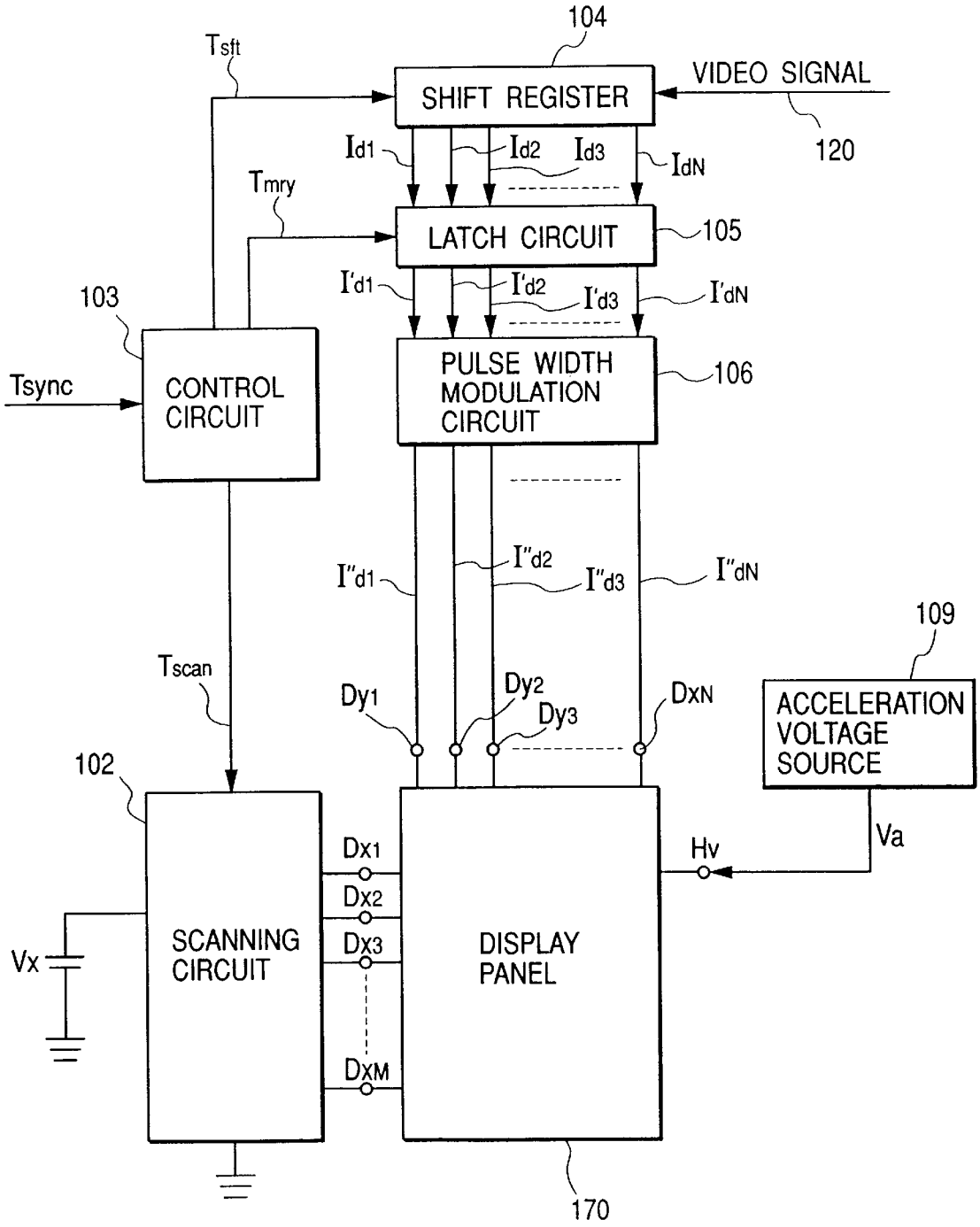
FIG. 12 is a block diagram of a driving circuit for driving the image-forming apparatus produced in Embodiments.

In FIG. 12 the display panel 170 corresponds to the aforementioned airtight vessel (see FIG. 10).

The electron-emitting devices are connected to the external driving circuit via the row-directional wire terminals Dx1 to DxM connected to the row-directional wires 106 in the display panel 170 and via the column-directional wire terminals Dy1 to DyN connected to the column-directional wires 107 in the display panel 170. Inputted from a scanning circuit 102 into the row-directional wire terminals Dx1 to DxM out of them are scanning signals for successively selecting the multiple electron sources provided in this display panel 170, i.e., the surface conduction electron-emitting devices wired in the matrix of M rows and N columns, one by one to drive them. On the other hand, applied to the column-directional wire terminals Dy1 to DyN are modulation signals for controlling electrons emitted from each of the surface conduction electron-emitting devices in one row selected by a scanning signal applied to a row-directional wire 106 from the scanning circuit 102, according to the video signal input.

A control circuit 103 functions to time the operations of the respective sections so as to carry out an appropriate display based on the video signal input from the outside. Here the video signal 120 inputted from the outside can be one in which image data and a synchronizing signal are composite, for example, as in the case of NTSC signals, or one in which they are preliminarily separated. The present embodiment will be described in the case of the latter. The former video signal can also be handled in a similar fashion to that in the present embodiment by separating the image data from the synchronizing signal Tsync by a well-known synchronization separating circuit and supplying the image data to a shift register 104 and the synchronizing signal to the control circuit 103.

Here the control circuit 103 generates control signals such as a horizontal synchronizing signal Tscan, a latch signal Tmry, a shift signal Tsft, etc. for the respective sections, based on the sync signal Tsync supplied from the outside.

The image data (luminance data) included in the video signal supplied from the outside is inputted into the shift register 104. This shift register 104 is for serial-parallel conversion of the image date serially inputted in time series in units of lines of the image and retains the image data serially inputted in synchronization with the control signal (shift signal) Tsft supplied from the control circuit 103. The image data of one line (corresponding to driving data for N electron-emitting devices), after converted into parallel signals in the shift register 104 in this way, is outputted as parallel signals Id1 to IdN to a latch circuit 105.

The latch circuit 105 is a storage circuit for storing the image data of one line for a required time, which stores the parallel signals Id1 to IdN according to the control signal Tmry sent from the control circuit 103. The image data stored in the latch circuit 105 in this way is outputted as parallel signals I'd1 to I'dN to a pulse width modulation circuit 106. The pulse width modulation circuit 106 outputs voltage signals I"d1 to I"dN whose pulse widths are modulated according to the image data (I'd1 to I'dN) at a constant amplitude (voltage value) in accordance with these parallel signals I'd1 to I'dN.

More specifically, the higher the luminance level of the image data, the wider the pulse width of the voltage pulse outputted from this pulse width modulation circuit 106; for example, the circuit outputs voltage pulses having the pulse width in the range of 30 $\mu$sec for the maximum luminance to 0.12 $\mu$sec for the minimum luminance and the amplitude of 7.5 [V]. These output signals I"d1 to I"dN are applied to the column-directional wire terminals Dy1 to DyN of the display panel 170.

An acceleration voltage source 109 supplies a dc voltage Va, for example, of 5 kV to the high-voltage terminal Hv of the display panel 170.

Next, the scanning circuit 102 will be described. This circuit 102 incorporates M switching devices inside, each switching device selecting either the output voltage of a dc voltage source Vx or 0 [V] (the ground level) and being electrically connected to the outside terminal Dx1 to DxM of the display panel 170. Switching of these switching devices is carried out based on the control signal Tscan outputted from the control circuit 103. In practice the scanning circuit can be constructed readily by combination with the switching devices such as FETs, for example. The dc voltage source Vx is set to output such a constant voltage that the driving voltage applied to non-scanned devices is not more than the electron emission threshold voltage Vth, based on the characteristics of the electron-emitting devices. The control circuit 103 has the function of timing the operations of the respective sections so as to perform the appropriate display based on the image signal input from the outside.

The shift register 104 and the line memory 105 can be either of the digital signal type or of the analog signal type. Namely, the point is that the serial-parallel conversion and storage of image signals are carried out at a predetermined rate.

In the image display apparatus of the present embodiment that can be constructed as described above, each electron-emitting device emits electrons when the voltage is applied thereto via the outside terminals Dx1 to DxM, Dy1 to DyN. The electron beam is accelerated by applying the high voltage to the metal back 112 or to the transparent electrode (not illustrated) via the high voltage terminal Hv. The electrons thus accelerated hit the fluorescent film 111 to emit light, thus forming an image.

It is noted that the structure of the image display apparatus stated herein is just an example of the image-forming apparatus to which the present invention is applicable and that a variety of modifications and changes can be made based on the thought of the present invention. The input signals of the NTSC system were exemplified herein, but the input signals are not limited to those. For example, they may be of the PAL system, the SECAM system, etc., and other systems of TV signals with the greater number of scanning lines (high-definition TV including the MUSE system) can also be employed.

Next, an example of the method for producing the image-forming apparatus according to the present invention, using the surface conduction electron-emitting devices illustrated in FIG. 8 and FIG. 10, will be described below referring to FIGS. 1A to 1C and FIGS. 4A to 4E.

First described is the step of forming the rear plate 101.

Figure 4A:
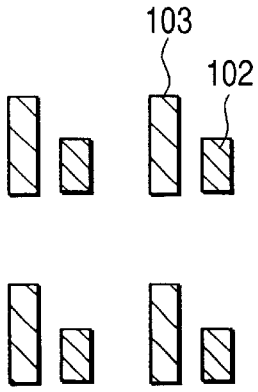
FIG. 4A, FIG. 4B, FIG. 4C, FIG. 4D, and FIG. 4E are top plan views to show production steps of the rear plate using the surface conduction electron-emitting devices.

(1) The rear plate 101 is cleaned well with detergent, pure water, and organic solvent and thereafter the material of the electrodes 102, 103 is deposited thereon. A method of the deposition is, for example, the vacuum film forming technology such as evaporation, sputtering, or the like. After that, patterning of the deposited electrode material is carried out by the photolithography-etching technology to form pairs of electrodes 102, 103 as illustrated in FIG. 4A.

This example showed the application of the photolithography technology, but it is preferable to employ the offset printing method in order to produce the electrodes at low cost, accurately, and readily over a large area. In the offset printing method, for example, an organic metal paste (ink) filled in recesses of an intaglio is transferred once onto a transfer medium called a blanket and the blanket is further pressed onto the rear plate to transfer the ink thereonto to print the electrode pattern. Then it is baked to form the electrodes.

Figure 1A:
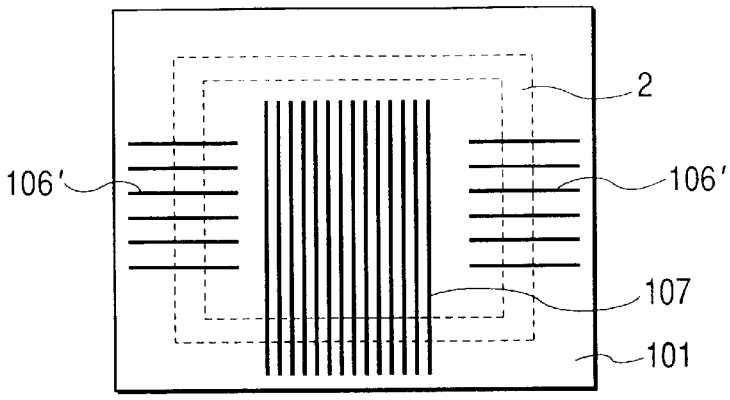
FIG. 1A, FIG. 1B, and FIG. 1C are explanatory diagrams to show a sequence of steps in the first embodiment of a method for forming the matrix wires according to the present invention.
Figure 4B:
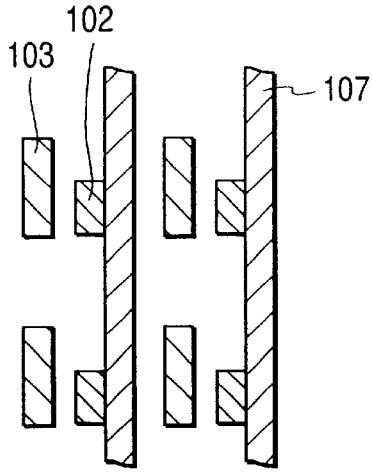

(2) Then the column-directional wires located inside the airtight vessel, and the takeout portions of the column-directional wires are formed as continuous column-directional wires 107 so as to cover a part of one electrode 103 of each device. At the same time, the takeout portions (first wires) 106' of the row-directional wires 106 are also formed (FIG. 1A and FIG. 4B).

Specifically, they are formed by applying an electrically conductive particles onto the rear plate, and baking (sintering) the particles, more specifically, applying a paste containing conductive particles onto the rear plate 101 on which the electrodes were formed in the preceding step (1), and baking the paste. More specifically, the printing methods are preferred. Among the printing methods, a preferred method is a method for forming the wire pattern of the paste on the rear plate through a mask with opening portions corresponding to the wire pattern to be formed, and the screen printing method is particularly preferable. As the above described conductive particles, ones with an average grain diameter 0.1 to 5 $\mu$m, desirably 0.3 to 1 $\mu$m may be used. Further, as a material, Ag, Au, Pt or the like may be used.

In the screen printing method the conductive paste (a paste containing conductive particles forming the wires, a binder, etc.) is applied onto the rear plate through the mask (screen plate) having the openings corresponding to the pattern of the column-directional wires 107 and the takeout portions (first wires) 106' of the row-directional wires. Subsequent to it, the paste thus applied is dried and baked to remove unnecessary organic substance out of the paste, thereby forming the column-directional wires 107, and the takeout portions (first wires) 106' of the row-directional wires.

The above wires can also be formed using a photosensitive, conductive paste containing a photosensitive material, as the above conductive paste. Specifically, the photosensitive, conductive paste is applied onto the entire surface of the rear plate 101 to be dried thereon. Subsequently, the paste is irradiated with (or exposed to) light in the desired pattern (the pattern of the column-directional wires and the pattern of the takeout portions of the row-directional wires). Thereafter, the unnecessary, photosensitive, conductive paste is removed from on the rear plate (development) and the paste is baked. The use of the photosensitive, conductive paste in this way permits the wires to be formed in high definition and is thus preferable.

The way of applying the paste onto the rear plate 101 according to the above screen printing method will be described referring to FIGS. 15A to 15C and FIG. 16.

Figure 15A:
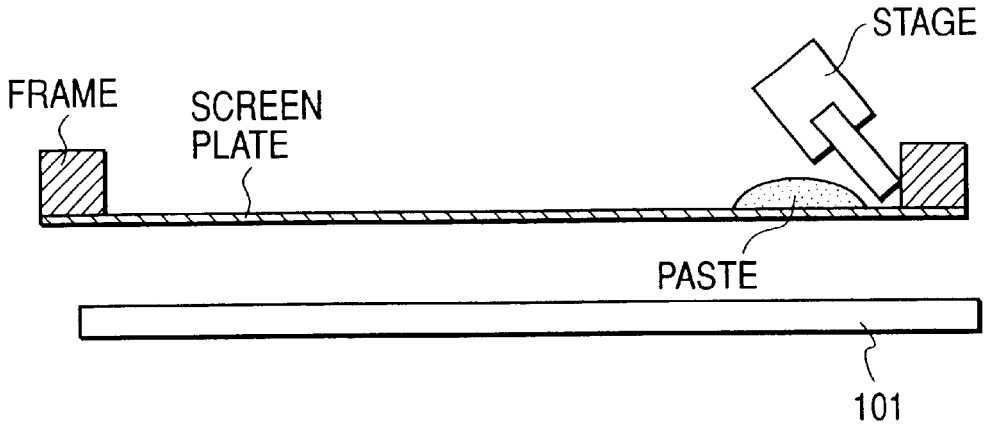
FIG. 15A, FIG. 15B, and FIG. 15C are process diagrams to show a process in the screen printing method.
Figure 16:
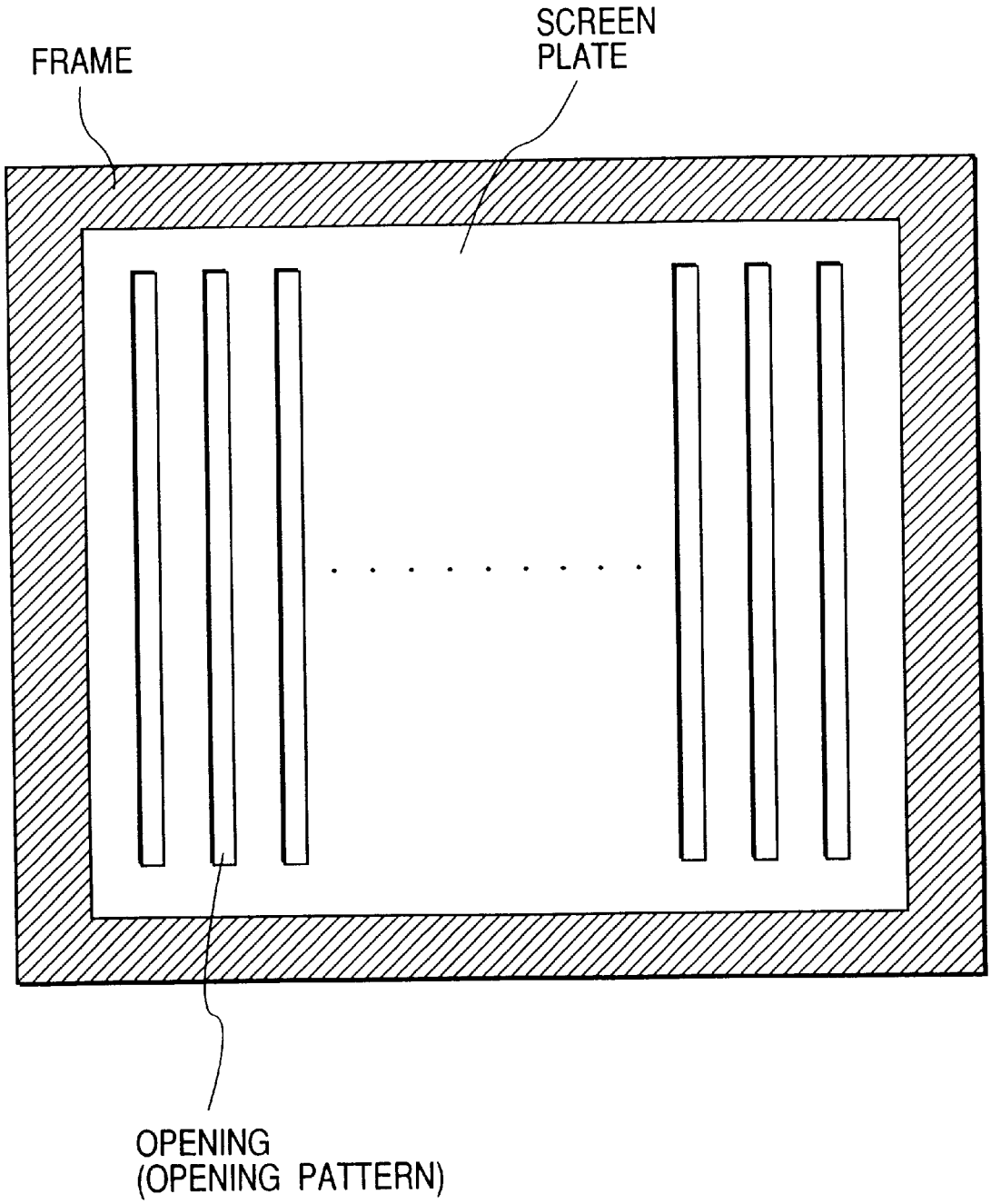
FIG. 16 is a schematic diagram to show a screen plate used in the screen printing method.

First, position alignment is carried out between the rear plate 101 prepared in above step 1 and the screen plate. Then the conductive paste is placed on the screen plate (FIG. 15A). In the screen plate the opening portions are formed corresponding to the patterns of the column-directional wires and the takeout portions of the row-directional wires (FIG. 16).

Figure 15B:
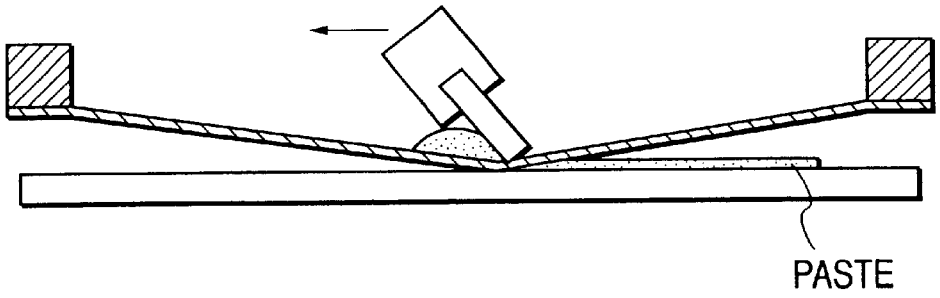
Figure 15C:
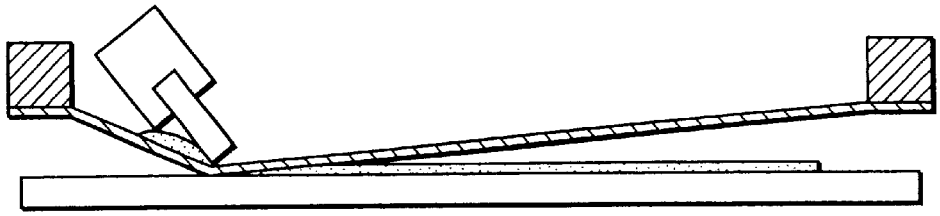

Subsequent to it, while a squeegee is urged against the screen plate, it is moved in a direction of an arrow illustrated in FIG. 15B, whereby the conductive paste is deposited in the desired patterns on the rear plate through the opening portions of the screen plate (FIG. 15B and FIG. 15C).

The aforementioned photosensitive, conductive paste can also be deposited by the screen printing method. Namely, the photosensitive, conductive paste is applied onto the desired regions on the rear plate by the screen printing method, and then is dried. After that, the aforementioned exposure, development, and baking steps are carried out to form the wires. This is preferable, because a waste amount of the photosensitive, conductive paste can be decreased.

The image-forming apparatus of this example is constructed so as to take the row-directional wires 106 out in the two directions. This is because the surface conduction electron-emitting devices generate the non-emitted current (device current (If)) in addition to the emission current (Ie). Namely, as described previously, more current flows to the row-directional wires 106 than to the column-directional wires 107 when a plurality of devices connected to one row-directional wire emit electrons in the line sequential scanning of the row-directional wires. This makes the voltage drop of the row-directional wires unignorable in the image-forming apparatus of large area. In the image-forming apparatus of the present example, therefore, the above voltage drop is restrained by taking the row-directional wires out in the two directions and supplying the voltage through the both ends of the row-directional wires.

Figure 1B:
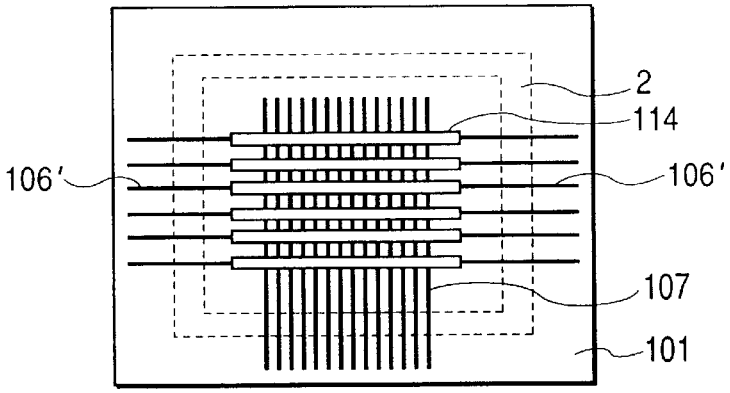
Figure 1B:
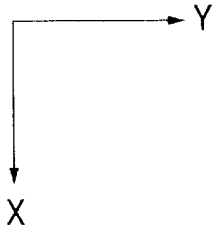
Figure 1C:
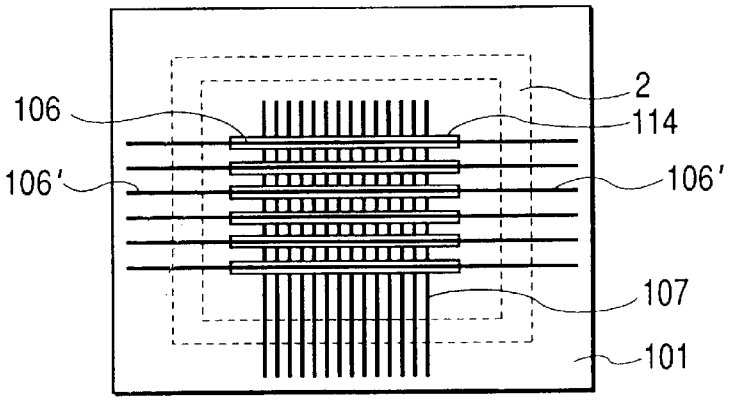

The region surrounded by dotted lines indicated by numeral 2 in FIGS. 1A to 1C represents a region in which the outer frame 109 and bonding material are placed.

Figure 4C:
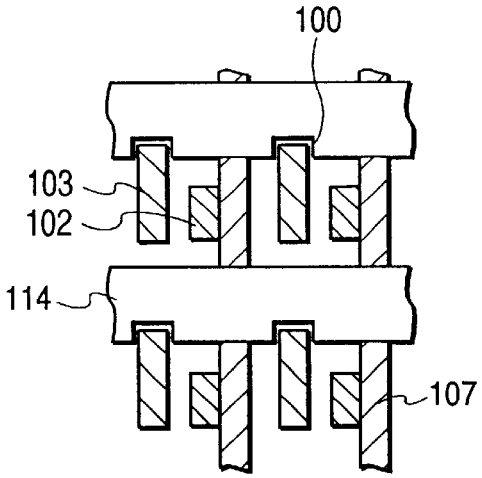

(3) Next, the insulating layers 114 are formed at the intersecting portions between the column-directional wires 107 already formed, and the row-directional wires 106 which will be produced in the next step (FIG. 1B and FIG. 4C).

The pattern of the insulating layers is, for example, a continuous form of the interdigital shape as illustrated in FIG. 4C, which can decrease the level difference (the sum of the thickness of the column-directional wires 107 and the thickness of the insulating layers 114) of the steps over and across which the row-directional wires pass at the intersecting portions with the column-directional wires. Further, the connections to the electrodes 102 become easier, because a part of each electrode 102 can be covered at an indent (recessed) part 100 of the insulating layers 114. The pattern of the insulating layers 114 may also be a discrete pattern in which the insulating layers are formed discretely only at the aforementioned intersections, without having to be limited to that illustrated in FIG. 4C.

There are no specific restrictions on methods for forming the insulating layers 114, but they are formed by applying an electrically conductive particles onto the rear plate, and baking (sintering) the particles, more specifically, applying a paste containing dielectric particles onto the rear plate 101 on which the wires were formed in step (2), and baking the paste. More specifically, the printing methods are preferable. Among the printing methods, a preferred method is a method for depositing the print paste onto the rear plate through a mask having opening portions corresponding to the pattern of the insulating layers to be formed. Particularly, it is desirable to form the insulating layers by the aforementioned screen printing method in order to assure good electric insulation and achieve low cost.

Specifically, in the screen printing method the insulating paste (a paste containing a glass filler as a dielectric particle, a binder, etc.) is applied onto the desired areas through the mask (screen plate) having the openings corresponding to the interdigital pattern. Then the paste thus applied is dried and baked to remove the unnecessary organic substance out of the paste, thus forming the insulating layers 114.

Further, the insulating layers 114 can also be formed using a photosensitive, insulating paste resulting from mixture of a photosensitive material in the above insulating paste, by carrying out the application thereof onto the rear plate, the drying, exposure, development, and baking steps in a similar fashion to those in step (2). It is also possible to deposit the photosensitive insulating paste by the screen printing method, as described in step (2). The use of the photosensitive insulating paste in this way permits the insulating layers 114 to be formed in higher definition.

The insulating layers 114 are preferably formed inside the aforementioned region 2 illustrated in FIGS. 1A to 1C (in the airtight vessel). This is for the following reasons. When the insulating layers are formed by the printing method, there exist the wire takeout portions and the insulating layers formed in the region 2 by the printing method and this increases the possibility of vacuum leak. Further, it is also for decreasing the possibility of unwanted charge-up of the insulators in the vacuum area, because the electron-emitting devices are used.

Further, the insulating layers 114 are preferably formed so as to connect the takeout portions 106' of the row-directional wires formed left and right on the rear plate in step (2), as illustrated in FIG. 1B. The reason of such formation is that it can make the electric connections securer between the row-directional wires 106 to be formed in the next step, and the row-directional wire takeout portions 106'.

Figure 4D:
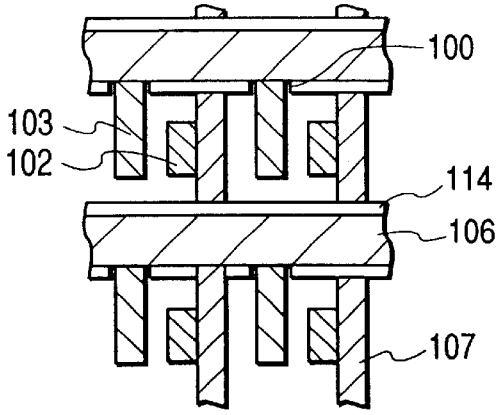

(4) Next, the row-directional wires (second wires) 106 located inside the airtight vessel are formed (FIG. 1C and FIG. 4D).

Specifically, the wires are formed by applying an electrically conductive particles onto the rear plate, and baking (sintering) the particles, more specifically, applying a paste containing particles of an electric conductor onto the rear plate 101 on which the insulating layers 114 were formed in previous step (3), and baking the paste. More specifically, the printing methods are preferable. Among the printing methods, a preferred method is a method for depositing the conductive paste onto the rear plate through a mask having opening portions corresponding to the wire pattern to be formed. As the above described conductive particles, ones with diameter 0.1 to 5 μm, desirably 0.3 to 1 μm are used. As material, Ag, Au, Pt or the like is desirable. Particularly, the screen printing method described in step (2) is preferable.

In the screen printing method the conductive paste (a paste containing metal particles for forming the wires, a binder, etc.) is applied onto the rear plate through the mask (screen plate) having the openings corresponding to the row-directional wire pattern.

Subsequent to it, the paste applied is dried and baked to remove the unnecessary organic substance out of the paste, thus forming the row-directional wires (second wires) 106 located in the airtight vessel.

Further, the row-directional wires 106 can also be formed using a photosensitive, conductive paste resulting from mixture of a photosensitive material in the conductive paste, by carrying out the application thereof onto the rear plate, the drying, exposure, development, and baking steps as in step (2). As described in step (2), it is also possible to deposit the photosensitive, conductive paste by the screen printing method. The use of the photosensitive, conductive paste in this way permits the row-directional wires 106 to be formed in higher definition.

With this step, the row-directional wires 106 cover parts of the electrodes 103 exposed at the opening portions 100 of the insulating layers 114 to make connections between the row-directional wires and the electrodes 103.

At the same time, connections are made between the takeout portions (first wires) 106' of the row-directional wires preliminarily formed in aforementioned step (2) and the row-directional wires (second wires) 106 located in the airtight vessel and formed in this step. These connections are preferably made by covering the ends of the takeout portions (first wires) 106' by the row-directional wires (second wires) 106 located in the airtight vessel. The formation of the row-directional wires (second wires) 106 located in the airtight vessel in this way can make the electric connections securer.

Figure 4E:
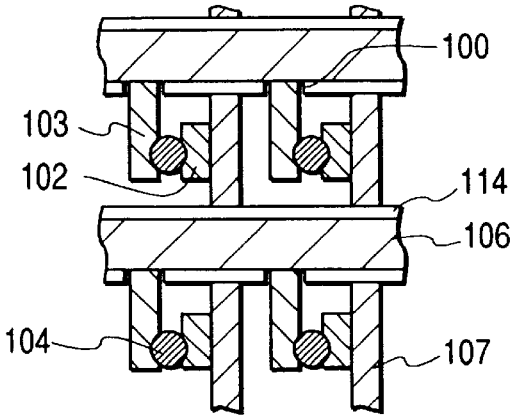
Figure 4E:
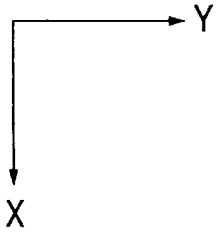

(5) Next, the conductive films 104 are formed between the electrodes 102, 103 of each pair. Any method can be adopted as a method for forming the conductive films 104, but a preferred method is the ink jet method capable of readily forming the conductive films over a large area at low cost. Specifically, the conductive films 104 are formed by applying liquid droplets including the material for forming the aforementioned conductive films to between the electrodes 102, 103 by use of an apparatus illustrated in FIG. 11A or 11B, and baking them (FIG. 4E).

The ink jet method is either one of the following methods; a method using a heating resistive element buried in a nozzle, in which a liquid droplet (ink) is ejected by pressure of a bubble formed when the resistive element heats the liquid to boil it (the bubble jet (BJ) method), a method for applying an electric signal to a piezo element so as to deform it, thereby inducing a change of the volume of a liquid chamber to eject a liquid droplet (the piezo jet (PJ) method), and so on. By either one of them the liquid containing the material for forming the conductive films is ejected and applied onto the locations where the conductive films are to be formed.

Figure 11A:
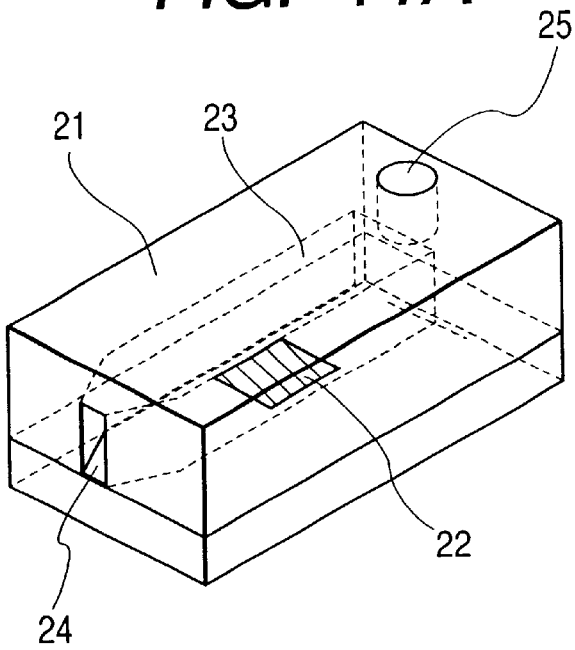
FIG. 11A and FIG. 11B are schematic diagrams of ink jet apparatus.
Figure 11B:
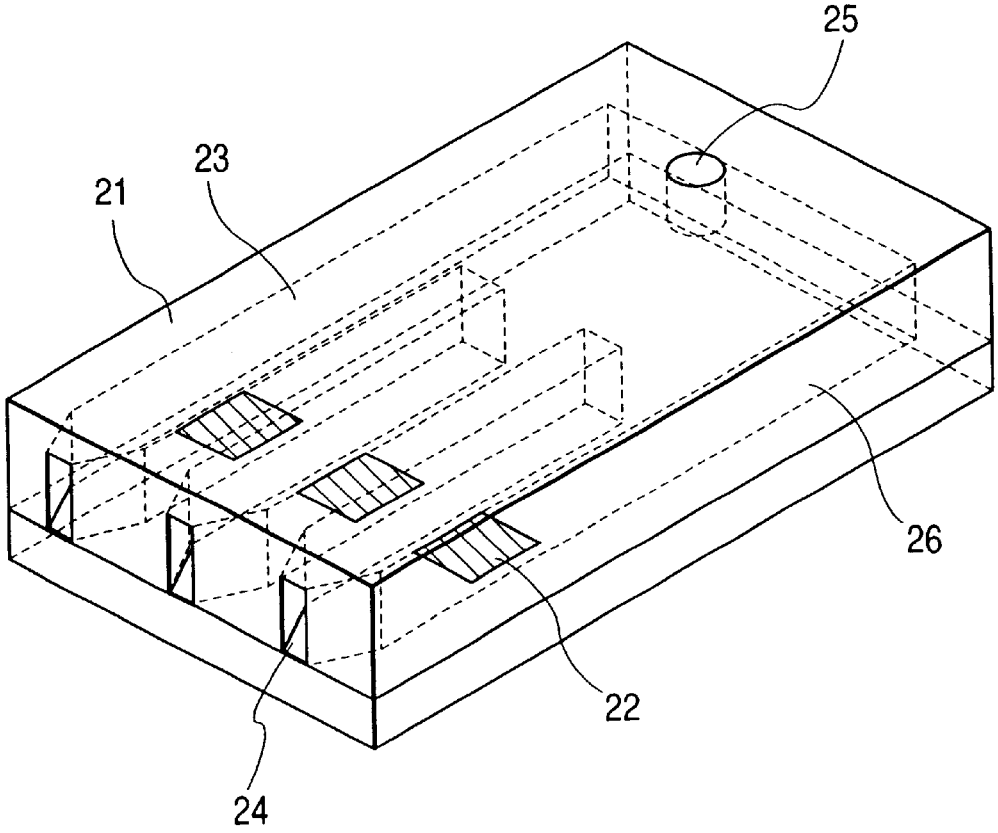

FIGS. 11A and 11B are schematic diagrams of ink jet heads (ejecting devices) used in the ink jet method. FIG. 11A shows a single nozzle head 21 having a single ejecting port (nozzle) 24. FIG. 11B shows a multi-nozzle head 21 having a plurality of droplet ejecting ports (nozzles) 24. Particularly, the multi-nozzle head is effective in producing displays in which a plurality of devices need to be formed on the substrate, because it can shorten the time necessary for application of the liquid. In FIGS. 11A and 11B, numeral 22 designates heaters or piezo elements, 23 ink (the above liquid) flow paths, 25 ink (the above liquid) supply portions, and 26 ink (the above liquid) reservoirs. A tank of the ink (the above liquid) is located apart from the head 21 and the tank is connected through a tube to the head 21 at the ink supply portion 25.

Liquids that can be used in the ink jet method are, for example, liquids in which particles of the aforementioned material are dispersed, liquids containing a compound such as a complex of the aforementioned material or the like, and so on, but they are not limited to these liquids.

(6) Next, a forming operation is carried out. An appropriate voltage is placed between the electrodes 102 and 103 of each pair to allow an electric current to flow in the conductive film 104, thereby forming a gap in a part of the conductive film 104. The gap formed by this operation and the vicinity thereof compose an electron-emitting region 105 (FIG. 8), where the activation operation described hereinafter is not carried out.

(7) Next, preferably, an activation operation is carried out. The activation operation is an operation of applying an appropriate voltage between the electrodes 102 and 103 under an atmosphere containing a carbon compound, thereby improving the electron emission characteristics. By this activation operation, carbon or a carbon compound is deposited on the substrate 101 in the gaps formed by the above forming operation, and on the conductive films 104 near the gaps. This step forms a second gap of each carbon film formed in the first gap made in the forming step. The second gaps are narrower than the first gaps. The execution of the activation operation can increase the emission current at the same applied voltage, as compared with that before the execution of the activation.

More specifically, voltage pulses are applied at regular intervals in a vacuum atmosphere in which an organic compound is introduced in the range of about $10^{-3}$ to $10^{-6}$ [Torr], thereby depositing carbon or the carbon compound originating in the organic compound present in the atmosphere.

The rear plate having the surface conduction electron-emitting devices (electron source substrate) 101 can be produced as described above.

According to the production method of the present invention described above, the wires of the takeout portions made of the aggregates of the conductive particles, located at the joint part (sealing part), are made through the baking steps during the aforementioned formation of the insulating layers and the row-directional wires.

In other words, it is simply considered that at least three baking steps can be assured for the wires (takeout portions) located at the joint part, when compared with a method of forming the wires located at the joint part in the last step. For this reason, the packing density is increased of the wires (takeout portions) located at the joint part, so that the vacuum leak can be restrained.

For assuring the longest baking time for the wires of the takeout portions, it can also be contemplated that only the wires (first wires) located at the joint part are formed first and the forming steps thereafter are carried out in the order of the column-directional wires (second wires), the insulating layers, and the row-directional wires (second wires)

located inside the airtight vessel, whereby the wires of the takeout portions are made through at least four baking steps. In another conceivable method, baking can also be carried out separately for a sufficient time after the formation of the takeout portions.

Such special baking step or baking time can also enhance the packing density and is thus effective to improvement in the airtightness. However, because it makes the production time longer on the other hand, it is thus not preferable in terms of the production cost.

It is thus most preferable to form the takeout portions (first wires) of the row-directional wires and the takeout portions (the first wires) of the column-directional wires at the same time as the wires formed first, without increase of the minimum baking steps necessary for the production of the row-directional wires, column-directional wires, and insulating layers, which had to be produced independently of each other.

According to the production method of the present invention described above, the row-directional wires can be formed in a state with the decreased level difference (or in a relatively flat state). Namely, the takeout portions of the row-directional wires can be formed on the very flat surface (the rear plate), by simultaneously forming them with the column-directional wires.

Since the row-directional wires formed in the airtight vessel are formed on the ends of the takeout portions of the row-directional wires and on the insulating layers, they can be formed on the relatively flat structure. As a consequence, the row-directional wires can be formed with accuracy and without occurrence of an electric connection failure at the step portions.

Next, the step of forming the face plate will be described.

Figure 14A:
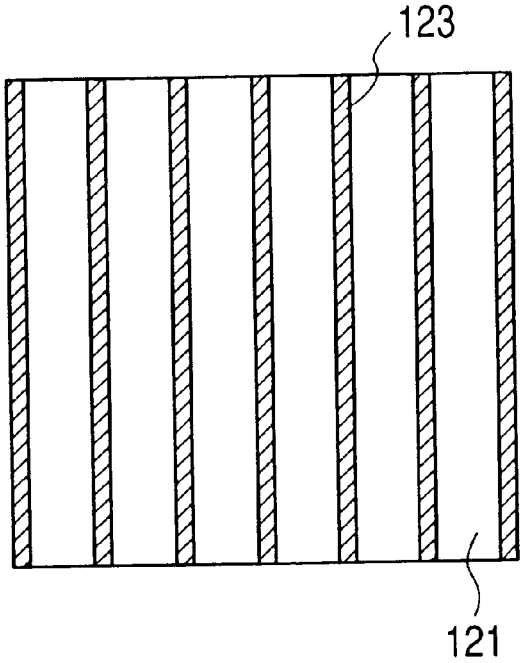
FIG. 14A and FIG. 14B are diagrams to show examples of forms of the fluorescent film in the image-forming apparatus produced in Embodiments.
Figure 14B:
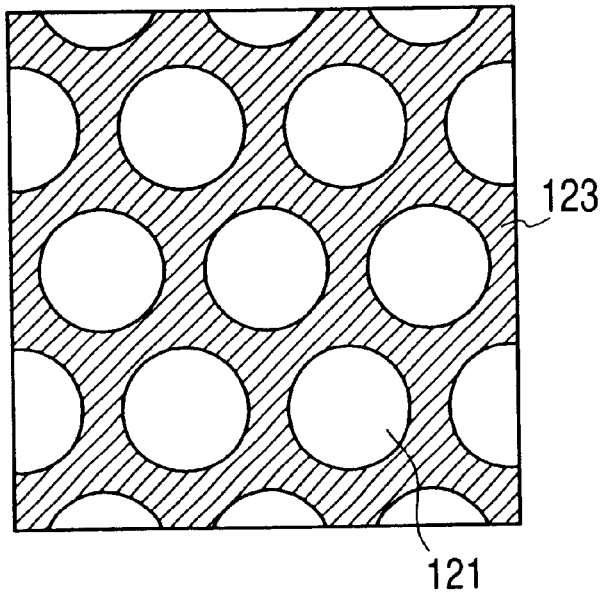

(8) First, the face plate 110 is cleaned well using the detergent, pure water, and organic solvent. After that, a black member (black matrix) 123 having a plurality of openings for placement of fluorescent material is formed on the face plate substrate 110, as illustrated in FIG. 14A or 14B. For example, a material containing graphite as a matrix is used for the black member, but the material of the black member is not limited thereto. In this example the black member is formed in stripes as illustrated in FIG. 14A by the printing method or the photolithography method. The pattern of the black member 123 may also be a matrix pattern as illustrated in FIG. 14B.

(9) Next, the fluorescent material 121 is laid at predetermined opening portions of the black member by the screen printing method or the like.

(10) Further, a filming layer is formed on the fluorescent material 121 and black member 123. A material of the filming layer is, for example, a resin of the polymethacrylate base, cellulose base, acrylic base, or the like, and the material dissolved in an organic solvent is applied by the screen printing method or the like and is dried.

(11) Next, a metal film (Al) is deposited on the filming layer by evaporation or the like.

(12) After that, the face plate is baked to remove the resin included in the fluorescent material paste, and the filming layer, thereby obtaining the face plate with the fluorescent material, the black member, and the metal back formed thereon.

(13) Between the face plate prepared as described above, and the rear plate 101 on which the electron-emitting devices etc. were formed through the previous steps, the spacers 20 and the outer frame 109 are placed and positioned.

The members are joined (sealed) by heating the bonding material placed at the joint portions between the outer frame and either of the face plate and the rear plate, thereby obtaining the airtight vessel (display panel) 170 illustrated in FIG. 10.

When the above sealing is carried out in a vacuum chamber, encapsulation can also be made at the same time as the sealing; therefore, the sealing in the vacuum chamber is preferable.

Although the present embodiment is arranged to carry out the sealing step after the formation of the electron-emitting regions, the above steps (6), (7) may also be carried out after the sealing of the rear plate having the electron-emitting devices before the forming produced in the above steps (1) to (5) and the face plate produced in the above steps (8) to (11).

The production methods of the present invention will be described in detail with embodiments thereof.

Embodiment 1

The image-forming apparatus produced by the production method of the present invention will be described below.

In the present embodiment the image-forming apparatus using the surface conduction electron-emitting devices as the electron-emitting devices illustrated in FIG. 10 was produced. The present embodiment will be described referring to FIGS. 1A to 1C, FIGS. 4A to 4E, and FIG. 10.

FIGS. 4A to 4E are top plan views to show the production steps of the rear plate 101 of the present example. In FIG. 4A to FIG. 4E, for simplicity of explanation, the rear plate is shown as an example in which totally four electron-emitting devices are formed in a matrix of 2×2 together with wires.

In FIGS. 4A to 4E, numerals 102 and 103 denote the electrodes formed by offset printing. The electrodes 102, 103, each pair of electrodes of the rectangular shape being spaced with the gap of 20 $\mu$m, are arrayed in the matrix of 1000 sets in the X-direction and 5000 sets in the Y-direction.

Numeral 107 denotes the column-directional wires formed by applying the conductive paste (ink) onto the rear plate 101 by the printing method and baking it. The conductive paste was a silver paste comprised of silver particles as a matrix (whose composition rate was about 78%), glass frit (about 2%), ethyl cellulose base resin binder (about 2%), and organic solvent (about 18%).

Numeral 114 designates stripes of insulating layers formed by applying the insulating paste (ink) containing low-melting-point glass by the printing method so as to be approximately perpendicular to the column-directional wires, and baking it. The insulating layers 114 have the notch-shaped opening portions 100 at the positions on the electrode 103 side.

Numeral 106 denotes the row-directional wires formed by applying the silver paste (ink) onto the insulating layers 114 by the printing method and baking it. The row-directional wires 106 are electrically connected to the electrodes 103 at the opening portions 100 of the insulating layers 114.

The column-directional wires 107, the insulating layers 114, and the row-directional wires 106 all are formed by the screen printing method.

The production method of the electron source substrate (rear plate) of the present embodiment will be described referring to FIGS. 4A to 4E and FIGS. 1A to 1C.

First prepared was the rear plate 101 in which pairs of electrodes 102, 103 were placed as illustrated in FIG. 4A.

Then the silver paste (ink) as a conductive paste was laid on the rear plate 101 so as to cover parts of the electrodes 102 by the aforementioned screen printing method. After that, it was baked to form the column-directional wires 107 having the width of 100 μm and the thickness of 12 μm. On this occasion, the takeout portions 106' of the row-directional wires 106 were also formed at the same time as the column-directional wires 107 (FIG. 1A and FIG. 4B). In this step the takeout portions of the column-directional wires, and the column-directional wires located inside the airtight vessel were formed as continuous wires at a time.

Then the insulating layers 114 were formed perpendicularly to the column-directional wires 107 by applying the insulating paste (ink) material by the screen printing method and baking it. The insulating paste (ink) material used herein was a paste (ink) comprised of a mixture of lead oxide as a matrix, a glass binder, and resin. This printing and baking was repeated four times to form stripes of interlayer insulating layers 114. The interlayer insulating layers 114 were formed so as to connect the ends of the takeout portions 106' of the row-directional wires formed before (FIG. 1B and FIG. 4C).

Then the silver paste (ink) was laid on the interlayer insulating layers 114 so as to cover parts of the electrodes 103 by the aforementioned screen printing method. After that, the paste was baked to form the row-directional wires 106 having the width of 100 μm and the thickness of 12 μm. The both ends of the row-directional wires 106 were formed so as to cover the ends of the takeout wires 106' of the row-directional wires formed before, whereby the row-directional wires 106 and the takeout portions 106' were connected to each other (FIG. 1C and FIG. 4D).

Through the above steps, the matrix wires were formed in the matrix of the stripes of the lower wires and the stripes of the upper wires perpendicular to each other through the interlayer insulating layers 114.

Next, the electron-emitting regions were formed.

First, liquid droplets of organic palladium aqueous solution were applied to between the electrode 102 and the electrode 103 of each device on the substrate by the ink jet method and thereafter a baking operation was carried out at 300° C. for ten minutes to form the desired pattern of conductive thin films 104 comprising Pd (FIG. 4E).

The principal element of the conductive thin films was Pd and the thickness thereof was 10 nm.

In this way the rear plate (electron source substrate) 101 before the forming was completed. Then the face plate 110 having the pattern of the fluorescent materials of the three primary colors (R, G, B) illustrated in FIG. 14A was positioned above the rear plate 101 while the outer frame 109 and spacers 20 with the frit glass preliminarily laid at the joint (sealing) portions were placed between the face plate and the rear plate. After that, they were pressed under heat to join (seal) the members to each other, thus forming the airtight vessel 170 (FIG. 10).

After that, the inside of the airtight vessel was evacuated down to $10^{-4}$ Pa and thereafter the "forming step" of applying the pulsed voltage to the column-directional wires 107 and row-directional wires 106 while hydrogen was introduced. By this step, the current was made to flow to each conductive film 104, so as to form the gap in part of each conductive film 104. In the forming step constant voltage pulses of 5 V were applied repeatedly. The voltage waveforms were triangular waves having the pulse width of 1 msec and the pulse spacing of 10 msec. The end of the energization forming operation was defined at a time when the resistance value of the conductive films became 1 MΩ or more.

Further, the devices after completion of the forming step were subjected to an operation called the activation step. The inside of the airtight vessel was evacuated down to $10^{-6}$ Pa and thereafter benzonitrile was introduced to $1.3\times10^{-4}$ Pa. Then the "activation step" of applying the pulsed voltage to each of the column-directional wires 107 and row-directional wires 106 was carried out. By this step, a carbon film was formed on the conductive films 104 inside the gap formed by the aforementioned forming and near the gap, thus obtaining the electron-emitting regions 105. In the activation step the pulse voltage having the pulse peak height of 15 V, the pulse width of 1 msec, and the pulse spacing of 10 msec was applied to each element.

After this, benzonitrile was discharged and thereafter the airtight vessel was sealed.

Then the airtight vessel 170 was connected to the driving circuit illustrated in FIG. 12. Then arbitrary voltage signals of 7 V were applied to the respective column-directional wires 107, the potential of −7 V was applied successively to the row-directional wires to scan them, and the other row-directional wires were kept at the potential of 0 V. An arbitrary image was able to be displayed when the anode voltage of 5 kV was applied to the metal back on the face plate.

This image-forming apparatus was driven continuously and it was verified that good images were able to be displayed over a long period without occurrence of the phenomenon due to the vacuum leak.

Embodiment 2

Figure 2A:
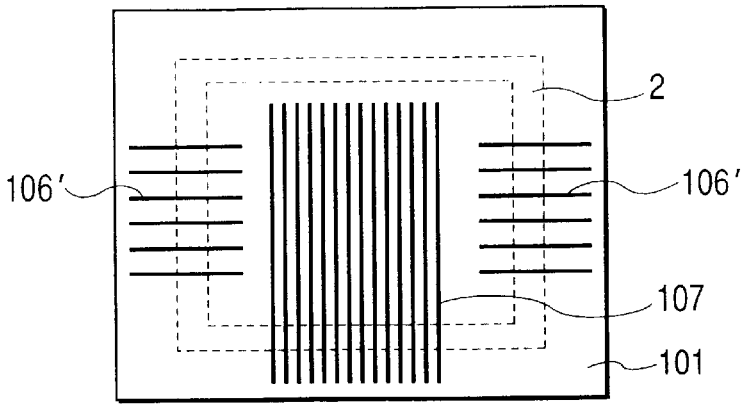
FIG. 2A, FIG. 2B, and FIG. 2C are explanatory diagrams to show a sequence of steps in the second embodiment.
Figure 2B:
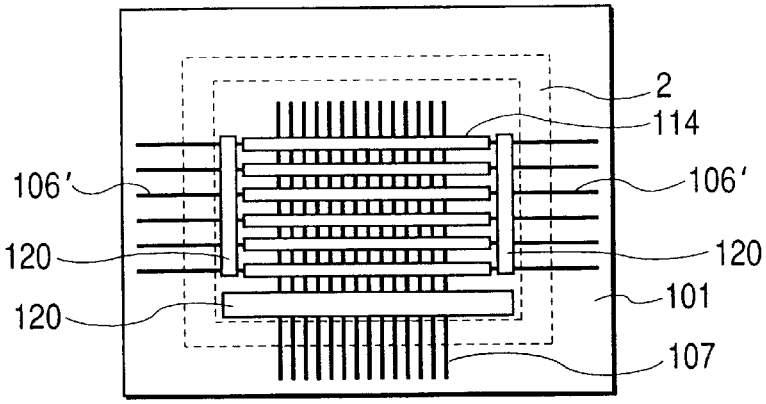
Figure 2B:
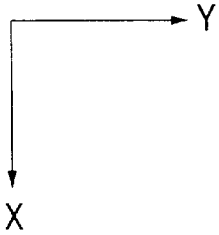
Figure 2C:
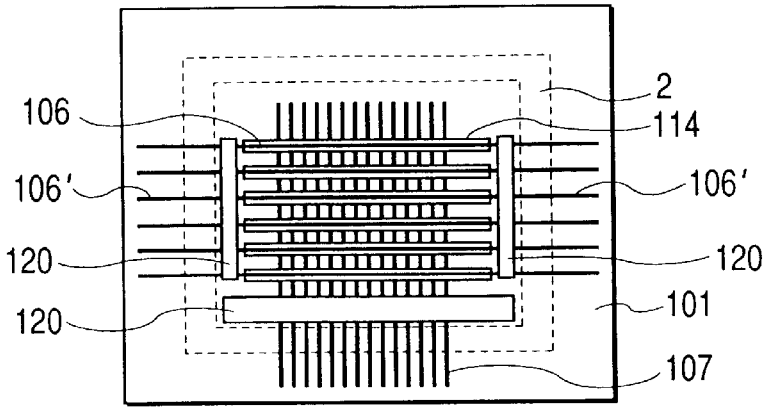

In the present embodiment the basically same image-forming apparatus as in Embodiment 1 was produced. In the present embodiment, however, insulating layers 120 were formed at three positions on the column-directional wires 107 outside the image-forming region and on the row-directional wires (takeout portions) outside the image-forming region, as illustrated in FIGS. 2A to 2C.

These insulating layers 120 were produced by the same step (FIG. 2B) as the step of forming the insulating layers 114 (FIG. 1B) discussed in Embodiment 1. These insulating layers 120 were also made of the same material and by the same process as the insulating layers 114 were.

The insulating layers 120 were provided in order to prevent a short from being caused between the wires when an evaporative getter was evaporated onto the rear plate outside the image-forming region. In the image-forming apparatus of the present embodiment, therefore, a Ba film of the getter material is formed on the insulating layers 120.

Since the production method and the structure of the image-forming apparatus other than these insulating layers 120 and the existence of the getter film are substantially the same as in Embodiment 1, the description thereof is omitted herein.

When the image-forming apparatus produced in the present embodiment was connected to the driving circuit illustrated in FIG. 12 and was driven, it was verified that the stable images were able to be obtained over a longer period than in Embodiment 1. Further, deterioration of image possibly due to the vacuum leak was not observed, as in the case of Embodiment 1.

Embodiment 3

Figure 3A:
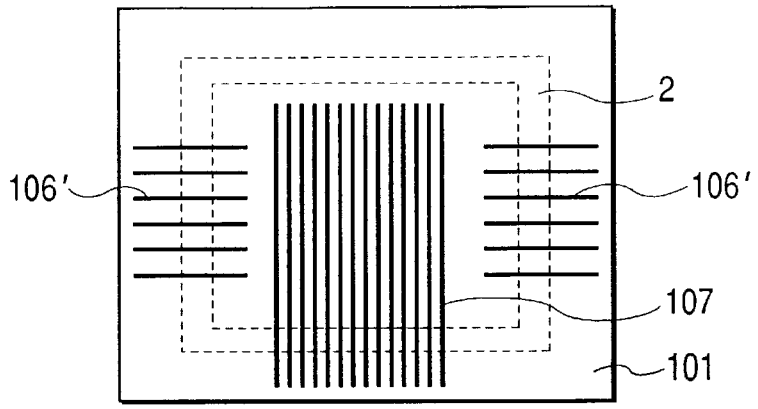
FIG. 3A, FIG. 3B, and FIG. 3C are explanatory diagrams to show a sequence of steps in the third embodiment.
Figure 3B:
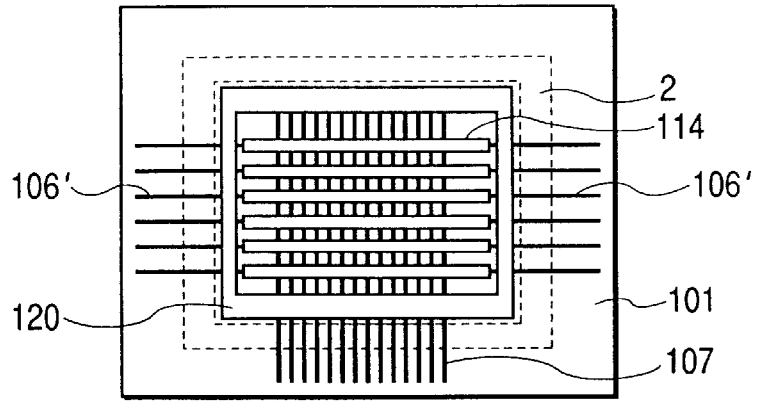
Figure 3B:
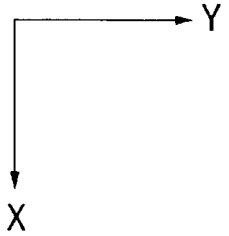
Figure 3C:
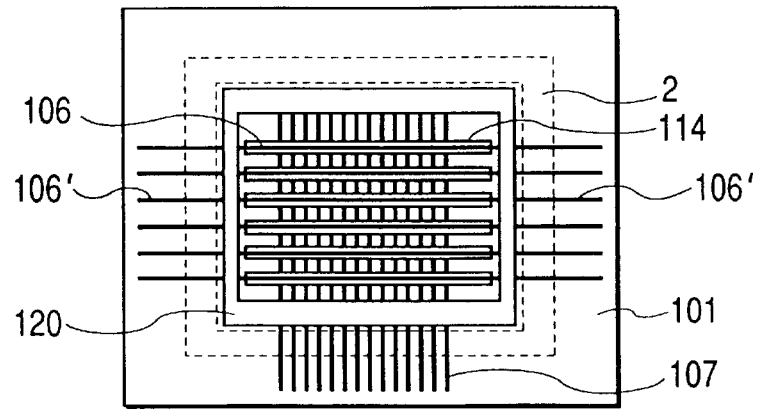

In the present embodiment, in addition to the structure of Embodiment 2, the insulating layer 120 was further arranged so as to surround the image-forming region as illustrated in FIGS. 3A to 3C. This insulating layer 120 was produced by the screen printing method, as in Embodiment 2.

In the present embodiment the insulating layer 120 was provided in order to place a non-evaporative getter of Zr—V—Fe on the rear plate outside the image-forming region so as to surround the image-forming region. In the image-forming apparatus of the present embodiment, therefore, a greater amount of the getter material is formed on the insulating layer 120 than in Embodiment 2. The getter material surrounds the image-forming region.

In the present embodiment, different from Embodiments 1 and 2, the sealing (joining) step of the face plate, the rear plate, and the outer frame was carried out in the vacuum chamber, after execution of the forming and activation steps. The aforementioned encapsulation was also effected simultaneously by this sealing step.

Since the production method and the structure of the image-forming apparatus except for the above are substantially the same as in Embodiment 1, the description thereof is omitted herein.

When the image-forming apparatus produced in the present embodiment was connected to the driving circuit illustrated in FIG. 12 and was driven, it was verified that the stable images were able to be obtained over a longer period than in Embodiment 2. Further, deterioration of image possibly due to the vacuum leak was not observed, as in the case of Embodiment 1.

Embodiment 4

In the present embodiment a photosensitive material, which reacted to ultraviolet light to be cured (or insolubilized), was added to the conductive paste and to the insulating paste used in Embodiment 1. In each of the forming steps of the wires 106, 107 and the insulating layers 114 described in Embodiment 1, either of the photosensitive, conductive paste and the photosensitive, insulating paste was applied onto the rear plate by the screen printing method and then was dried. Then, using the mask having openings corresponding to either of the wires 106, 107 and the insulating layers 114, the photosensitive paste was exposed to ultraviolet light to be cured. After that, the rear plate was cleaned with solvent and then was baked, thereby forming the wires 106, 107 and the insulating layers 114. The width of each of the wires 106, 107 and the insulating layers 114 formed in the present embodiment was smaller by 20% than that in Embodiment 1.

Since the image-forming apparatus illustrated in FIG. 10 was produced by the same steps as in Embodiment 1, except for the above step, the detailed description thereof is omitted herein.

The image-forming apparatus produced in the present embodiment was connected to the driving circuit illustrated in FIG. 12 and was driven, it was verified that images were able to be obtained in higher definition than in Embodiment 1. Further, deterioration of image possibly due to the vacuum leak was not observed, as in the case of Embodiment 1.

Embodiment 5

The present embodiment is an example in which the matrix wires were formed on the rear plate substrate 101 made of glass, which will be described referring to FIGS. 1A to 1C. FIGS. 1A to 1C are the plan views to show the process of forming the matrix wires.

In FIGS. 1A to 1C, numeral 101 designates the substrate and 2 the place at which the vacuum frame is placed. Numeral 107 denotes the column wires and 106' the takeout wires of the row wires intersecting with the bonding part of the outer frame. Numeral 114 represents the insulating layers and 106 the column wires. Here a part of each column wire intersects with the bonding part of the outer frame.

The procedures of the present embodiment will be described below.

First, the column wires 107 and the takeout wires 106' of the row wires were formed simultaneously on the glass substrate as illustrated in FIG. 1A. This formation was carried out by the screen printing in the present embodiment.

In this embodiment, the column wires 107 had the width of 90 $\mu$m, the takeout wires 106' of the row wires had the width of 160 $\mu$m, and the print paste was a silver paste. The glass substrate 1 after the printing was baked.

Next, the insulating layers 114 were formed by the screen printing as illustrated in FIG. 1B. The paste material was a glass paste in which the glass binder and resin were mixed in the matrix of lead oxide. In the present embodiment the above printing and baking of glass ink was repeated four times to form the insulating layers 114.

Finally, the row-directional wires 106 were formed with the silver paste on the insulating layers 114 by the screen printing method. On this occasion, the left and right ends of the row-directional wires 106 were connected to the respective takeout wires 106' of the row wires. The glass substrate 101 after the printing was baked. Through the above steps, the matrix wires were formed in the matrix of the stripes of the column wires and the stripes of the row wires perpendicular to each other through the insulating layers 114.

The matrix wires formed as described above had good characteristics without any discontinuity and without any short between the adjacent wires. The airtight vessel was formed by using the glass substrate 101 with the matrix wires thus formed and placing the outer frame at the predetermined place, and it was verified that no degradation occurred in the vacuum degree.

Embodiment 6

FIGS. 2A to 2C show an example in which the insulating films 120 for insulation of the vacuum getter were formed at the same time as the insulating layers 115 were, against Embodiment 5 described above. FIGS. 2A to 2C show states of formation of the insulating layers. After that, the row wires were formed as in Embodiment 5.

The matrix wires formed as described above had good characteristics without any discontinuity and without any short between the adjacent wires. Further, the airtight vessel was formed by using the glass substrate 101 with the matrix wires thus formed and placing the outer frame at the predetermined place, and thereafter getter flash was carried out. It was also verified that the matrix wires even after the getter flash had good characteristics without any discontinuity and without any short between the adjacent wires. Further, there was no problem as to the degree of vacuum.

Embodiment 7

A frame-shaped insulating layer pattern 120 was formed in part of the outer frame forming portion at the same time as the formation of the insulating layers 114 in the present embodiment, against Embodiment 5 described above. FIGS. 3A to 3C show states of formation of the insulating layers 114. After that, the row wires were formed as in Embodiment 5.

The matrix wires formed as described above had good characteristics without any discontinuity and without any short between the adjacent wires. The airtight vessel was formed by using the glass substrate 1 with the matrix wires thus formed and placing the outer frame at the predetermined place and it was verified that no degradation occurred in the degree of vacuum.

Embodiment 8

In the present embodiment the pattern illustrated in FIG. 1A was formed as thick films of the photosensitive paste by photolithography, against the first Embodiment described above. After that, the matrix wires were formed similarly as in Embodiment 5. The result was as good as in Embodiment 5.

Embodiment 9

Figure 9:
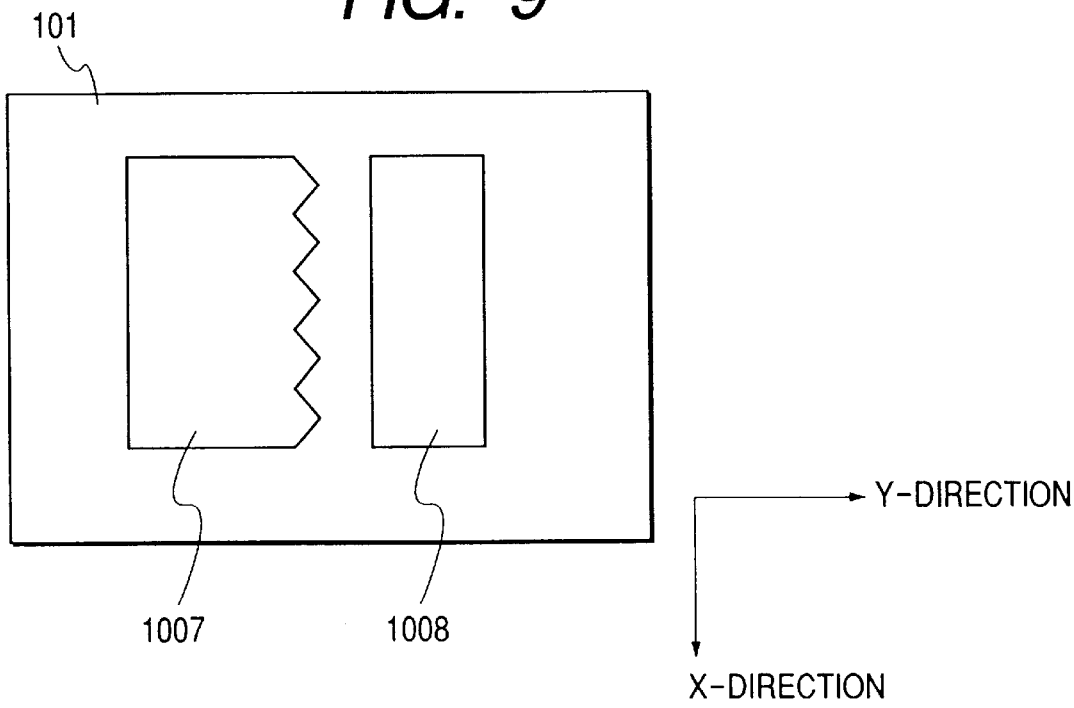
FIG. 9 is a plan view to show an example of a transverse type electron-emitting device.

The present embodiment used the transverse electron-emitting devices illustrated in FIG. 9, as the electron-emitting devices of the image-forming apparatus formed in Embodiment 1. In FIG. 9 numeral 1007 designates an emitter electrode and 1008 a gate electrode. When the gate electrode is set at a higher voltage than the emitter electrode, the emitter electrode emits electrons.

The image-forming apparatus of the present embodiment is the same as the structure of the image-forming apparatus illustrated in FIG. 10, except for the difference of the electron-emitting devices. Therefore, the production process of the electron-emitting devices, corresponding to FIGS. 4A to 4E used in Embodiment 1, will be described herein using FIGS. 17A to 17D.

Figure 17A:
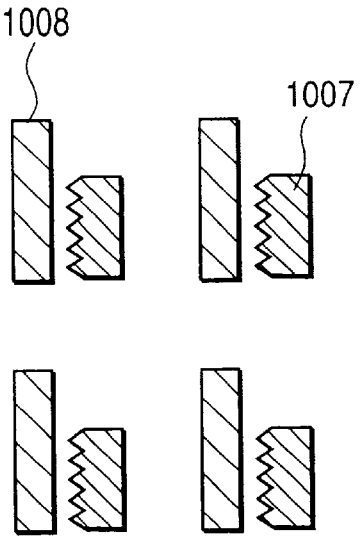
FIG. 17A, FIG. 17B, FIG. 17C, and FIG. 17D are schematic diagrams to show a production process of the rear plate produced in Embodiment.

First prepared was the rear plate 101 on which pairs of electrodes 1007, 1008 were placed, as illustrated in FIG. 17A.

Figure 17B:
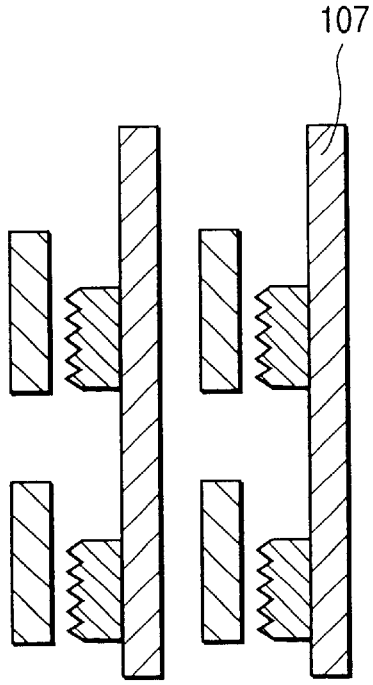

Next, the silver paste (ink) as a conductive paste was deposited on the rear plate 101 so as to cover parts of electrodes 1007 by the aforementioned screen printing method. After that, it was baked to form the column-directional wires 107 having the width of 100 $\mu$m and the thickness of 12 $\mu$m. On this occasion, the takeout portions 106' of the row-directional wires 106 were also formed at the same time as the column-directional wires 107 were (FIG. 1A or FIG. 17B). In this step the takeout portions of the column-directional wires and the column-directional wires located inside the airtight vessel were formed as continuous wires at a time.

Figure 17C:
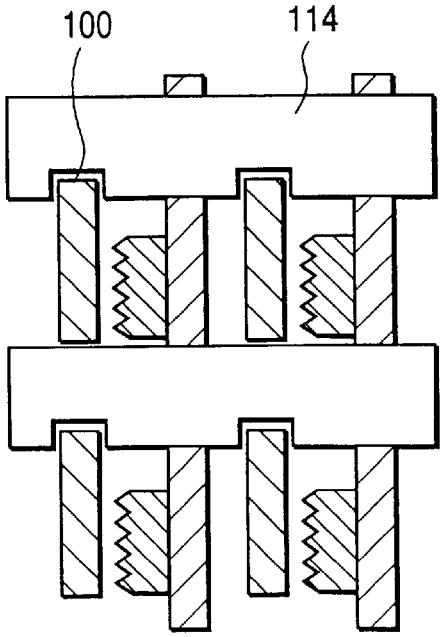

Next, the interlayer insulating layers 114 were laid perpendicularly to the column-directional wires 107 by the screen printing method and were baked. The insulating paste (ink) material used herein was the paste (ink) in which the glass binder and resin were mixed in the matrix of lead oxide. This printing and baking is repeated four times to form the stripes of interlayer insulating layers 114. The interlayer insulating layers 114 were formed so as to connect the ends of the takeout portions 106' of the row-directional wires formed previously (FIG. 1B or FIG. 17C).

Figure 17D:
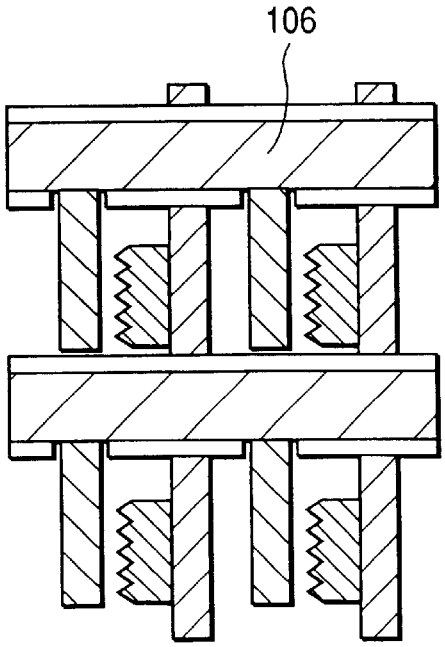

Next, the silver paste (ink) was deposited on the interlayer insulating layers 114 so as to cover parts of the electrodes 1008 by the screen printing method. After that, it was baked to form the row-directional wires 106 having the width of 100 $\mu$m and the thickness of 12 $\mu$m. The both ends of the row-directional wires 106 were formed so as to cover the ends of the takeout wires 106' of the row-directional wires formed previously, thereby connecting the row-directional wires 106 to the takeout portions 106' (FIG. 1C or FIG. 17D).

Through the above steps, the matrix wires were formed in the matrix of the stripes of lower wires and the stripes of upper wires perpendicular to each other through the interlayer insulating layers 114.

In this way the rear plate 101 was completed with the electron-emitting devices being formed in the array. The face plate 110 having the fluorescent materials of the three primary colors (R, G, B) in the pattern of FIG. 14A was positioned above this rear plate 101 while the outer frame 109 2 mm high and the spacers 20 with the frit glass preliminarily laid on the joint (sealing) part were placed between the face plate and the rear plate. After that, the members were pressed under heat in the vacuum chamber to be joined (or sealed), thereby forming the airtight vessel 170.

Then this airtight vessel (image-forming apparatus) was connected to the driving circuit illustrated in FIG. 12 and was driven and it was verified that the phenomenon due to the vacuum leak was not observed and that good images were able to be displayed over a long period.

As described above, the present invention can enhance the denseness of the wires passing through the joint part (sealing part) without increase of the process time. As a consequence, the inside of the airtight vessel can be maintained in a pressure-reduced state for a long time. Further, the invention can restrain the discontinuity of the row-directional wires placed on the plurality of column-directional wires so as to be substantially perpendicular to the column-directional wires formed on the substrate, and can also restrain occurrence of the electric connection failure.

What is claimed is:

1. A method for producing an image-forming apparatus comprising an airtight vessel in which a rear plate having an electron-emitting device and a wire connected to the device, and a face plate having an electrode are sealed to each other through a bonding material, said method comprising the following steps:

(A) a first step of forming a first wire which is a part of said wire and which passes through said sealing part to connect the inside of said vessel to the outside, by applying a paste comprising conductive particles and baking said paste; and (B) a second step of forming a second wire located in said vessel, by applying a paste comprising conductive particles so as to be connected to said first wire inside said vessel and baking said paste, after formation of said first wire.

2. The method according to claim 1, wherein said second wire is formed so as to cover a part of said first wire.

3. The method according to claim 1, wherein said wire comprises a plurality of row-directional wires extending in a row direction and a plurality of column-directional wires extending substantially perpendicularly to the row direction, said column-directional wires being electrically insulated from the row-directional wires, wherein said row-directional wires are formed by said first step and said second step.

4. The method according to claim 3, wherein an insulating layer is formed between said row-directional wires and column-directional wires at intersecting portions between said row-directional wires and column-directional wires and wherein said row-directional wires are formed so as to cover said column-directional wires through said insulating layer.

5. The method according to claim 4, further comprising a step of forming said insulating layer between said first step and second step.

6. The method according to claim 4, wherein said insulating layer is formed by applying a paste comprising dielectric particles and baking said paste.

7. The method according to claim 4, wherein said insulating layer is formed in a pattern of lines extending in said row direction so as to be connected to parts of the row-directional wires formed in said first step.

8. The method according to claim 4, wherein a thickness of said row-directional wires is larger than a thickness of said column-directional wires.

9. The method according to claim 3, wherein said column-directional wires are formed in the same step as said first step of forming said row-directional wires.

10. The method according to claim 1, wherein said electron-emitting device comprises a first electrode and a second electrode, said method further comprising a step of forming said first electrode and second electrode, prior to said first step.

11. The method according to claim 10, further comprising a step of forming an electroconductive film connecting said first electrode to the second electrode, which is carried out after said second step.

12. The method according to claim 1, wherein said rear plate and said face plate are further sealed through an outer frame.

13. The method according to claim 1, wherein said paste further comprises a photosensitive material.

14. The method according to claim 1, wherein said wire is formed by a printing method.

15. The method according to claim 14, wherein said wire is formed by a screen printing method.

16. An image-forming apparatus produced by the method as set forth in either one of claims 1 to 15.

* * * * *

UNITED STATES PATENT AND TRADEMARK OFFICE

CERTIFICATE OF CORRECTION

PATENT NO. : 6,426,588 B1
DATED : July 30, 2002
INVENTOR(S) : Yoshihiro Yanagisawa It is certified that error appears in the above-identified patent and that said Letters Patent is hereby corrected as shown below:

Column 2,
Line 57, “the-above” should read -- the above --.

Column 3,
Line 3, “it,” should read -- this, --.

Column 4,
Line 20, “electrode-are” should read -- electrode are --;
Line 65, “securer” should be deleted; and
Line 66, “connections” should read -- connections more secure --.

Column 6,
Line 32, “either” should be deleted.

Column 11,
Line 7, “converted” should read -- being converted --.

Column 12,
Line 39, “an” should be deleted; and
Line 50, “above described” should read -- above-described --.

Column 13,
Line 8, “on” should read -- the surface of --.

Column 14,
Line 8, “an” should be deleted;
Line 51, “of” should read -- for --; and
Line 59, “an” should be deleted.

Column 15,
Line 2, “above described” should read -- above-described --; and
Line 48, “to” should be deleted.

Column 17,
Line 7, “to” should read -- for --.

UNITED STATES PATENT AND TRADEMARK OFFICE

CERTIFICATE OF CORRECTION

PATENT NO. : 6,426,588 B1
DATED : July 30, 2002
INVENTOR(S) : Yoshihiro Yanagisawa It is certified that error appears in the above-identified patent and that said Letters Patent is hereby corrected as shown below:

Column 19,
Line 9, “a” should read -- one --; and
Line 37, “to” should be deleted.

Column 20,
Line 43, “114 were.” should read -- 114. --.

Column 22,
Line 42, “against” should read -- as opposed to --; and
Line 61, “against” should read -- as opposed to --.

Column 23,
Line 44, “a” should read -- one --.

Column 24,
Line 19, “denseness” should read -- density --.

Signed and Sealed this

Fifteenth Day of June, 2004

JON W. DUDAS
*Acting Director of the United States Patent and Trademark Office*